US008672690B2

(12) United States Patent
Mizukami et al.

(10) Patent No.: US 8,672,690 B2
(45) Date of Patent: Mar. 18, 2014

(54) ELECTRONIC CONNECTOR INCLUDING GROUNDING PART HAVING PROTRUSION INTERPOSED BETWEEN TERMINAL CONNECTING PARTS

(75) Inventors: Kazuhiro Mizukami, Tokyo (JP); Takeshi Okuyama, Tokyo (JP); Tadashi Kumamoto, Tokyo (JP); Toshihiro Kusagaya, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/278,324

(22) Filed: Oct. 21, 2011

(65) Prior Publication Data

US 2012/0135615 A1 May 31, 2012

(30) Foreign Application Priority Data

Nov. 30, 2010 (JP) ..... 2010-267444

(51) Int. Cl.
*H01R 13/648* (2006.01)

(52) U.S. Cl.
USPC ..... 439/108

(58) Field of Classification Search
USPC ..... 439/101, 108, 188, 502, 504
See application file for complete search history.

(56) References Cited

U.S. PATENT DOCUMENTS

| | | | | |
|---|---|---|---|---|
| 6,142,804 | A * | 11/2000 | Peloza et al. | 439/188 |
| 6,164,995 | A * | 12/2000 | Peloza | 439/188 |
| 6,280,209 | B1 | 8/2001 | Bassler et al. | |
| 6,923,664 | B2 * | 8/2005 | Ito et al. | 439/108 |
| 6,997,754 | B2 * | 2/2006 | Wan et al. | 439/676 |
| 7,165,981 | B2 * | 1/2007 | Bassler et al. | 439/101 |
| 7,488,188 | B2 * | 2/2009 | Moriyama et al. | 439/108 |
| 7,651,337 | B2 * | 1/2010 | McNamara | 439/65 |
| 7,708,569 | B2 * | 5/2010 | Sercu et al. | 439/108 |
| 7,713,088 | B2 * | 5/2010 | Sercu et al. | 439/607.1 |
| 7,815,468 | B2 * | 10/2010 | Mizukami | 439/607.34 |
| 8,152,539 | B2 * | 4/2012 | Moriyama et al. | 439/108 |
| 2004/0224559 | A1 * | 11/2004 | Nelson et al. | 439/608 |
| 2004/0224564 | A1 * | 11/2004 | Wan et al. | 439/676 |

FOREIGN PATENT DOCUMENTS

JP 2005-005272 1/2005

* cited by examiner

*Primary Examiner* — Chandrika Prasad
(74) *Attorney, Agent, or Firm* — IPUSA, PLLC

(57) ABSTRACT

An electronic connector includes a plurality of pairs of terminal parts for transmitting an electric signal; and grounding parts shaped like plates and connected to have a ground potential, wherein the grounding parts have protrusions protruding on a side of the pairs of terminal parts, and the protrusions are respectively interposed between the pairs of terminal parts which are adjacent to each other.

9 Claims, 38 Drawing Sheets

ELECTRONIC CONNECTOR INCLUDING GROUNDING PART HAVING PROTRUSION INTERPOSED BETWEEN TERMINAL CONNECTING PARTS

CROSS-REFERENCE TO RELATED APPLICATIONS

This patent application is based upon and claims the benefit of priority of the prior Japanese Patent Application No. 2010-267444 filed on Nov. 30, 2010, the entire contents of which are incorporated herein by reference.

FIELD

The embodiments discussed herein are related to an electronic connector.

BACKGROUND

An electronic connector is a connecting member for electronically connecting an electronic device, an electronic apparatus or the like and transmitting an electronic signal or the like. There are various types of electronic connectors depending on uses. The electronic connectors are selected depending on the uses. For example, in order to transmit a high-frequency signal, there is a connector for high-frequencies.

Japanese Laid-open Patent Publication No. 2005-005272 discloses a high frequency electronic connector which minimizes discontinuity of impedances through the electronic connector, thereby enhancing high speed data transmission.

SUMMARY

According to an aspect of the embodiment, an electronic connector includes a plurality of pairs of terminal parts for transmitting an electric signal; and grounding parts shaped like plates and connected to have a ground potential, wherein the grounding parts have protrusions protruding on a side of the pairs of terminal parts, where the protrusions are respectively interposed between the pairs of terminal parts which are adjacent to each other.

The object and advantages of the invention will be realized and attained by means of the elements and combinations particularly pointed out in the appended claims.

It is to be understood that both the foregoing general description and the following detailed description are exemplary and explanatory and are not restrictive of the invention, as claimed.

DESCRIPTION OF EMBODIMENTS

As described previously, there may be a high frequency electronic connector which minimizes discontinuity of impedances through the electronic connector for high speed data transmission. However, a high frequency signal is apt to receive various noises or the like. Especially, if a positional relationship between a ground (GND) terminal and a signal terminal changes in the high frequency electronic connector, a characteristic impedance in a signal terminal may be affected. In this case, degradation, loss and so on of a transmitted signal are increased to negatively affect high-speed signal transmission. Further, many of the high frequency electronic connectors have plural connection terminals for improving a data transmission speed. Therefore, it is preferable to provide an electronic connector in which a density of arranging connection terminals is as high as possible to render the electronic connector to be compact.

Preferred embodiments of the present invention will be explained with reference to accompanying drawings. The same reference symbols are attached to the same portions and so on.

[a] First Embodiment (Electronic Connector)

The electronic connector of First Embodiment is described. The electronic connector of First Embodiment includes a plug electronic connector and a corresponding jack electronic connector to be connected to each other to enable connecting electronic apparatuses and transmitting a high frequency electronic signal at high speeds.

Figure 1A:
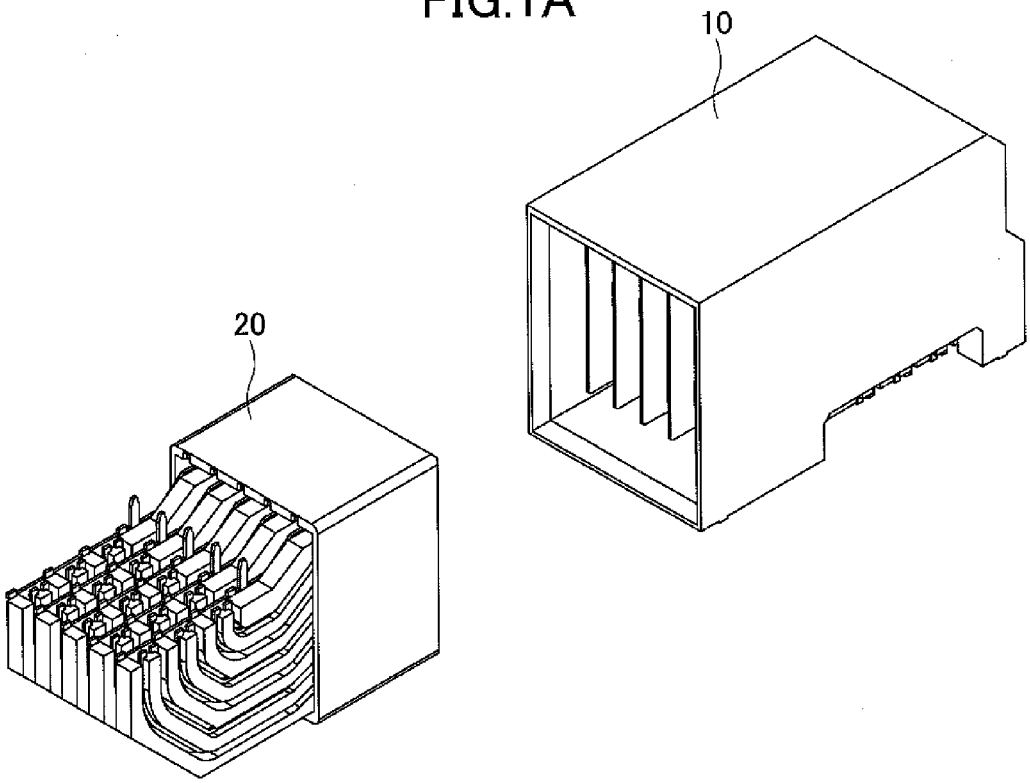
FIG. 1A is perspective views of a plug electronic connector and a jack electronic connector of a First Embodiment of the present invention.
Figure 1B:
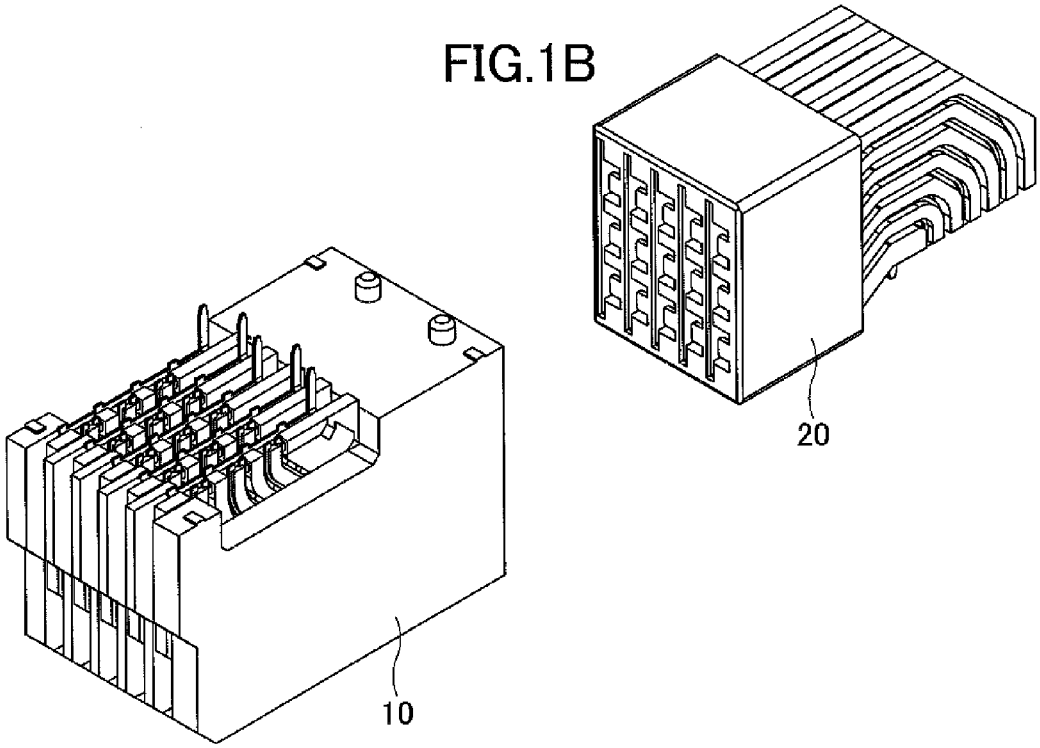
FIG. 1B is other perspective views of the plug electronic connector and the jack electronic connector of the First Embodiment.

Specifically, as illustrated in FIG. 1, a plug electronic connector 10 and a jack electronic connector 2 are used. FIG. 1A is a perspective view of the plug electronic connector 10 and the jack electronic connector 20. FIG. 1B is a perspective view of the plug electronic connector 10 and the jack electronic connector 20 viewed from an opposite side of the FIG. 1A.

(Plug Electronic Connector)

Figure 2:
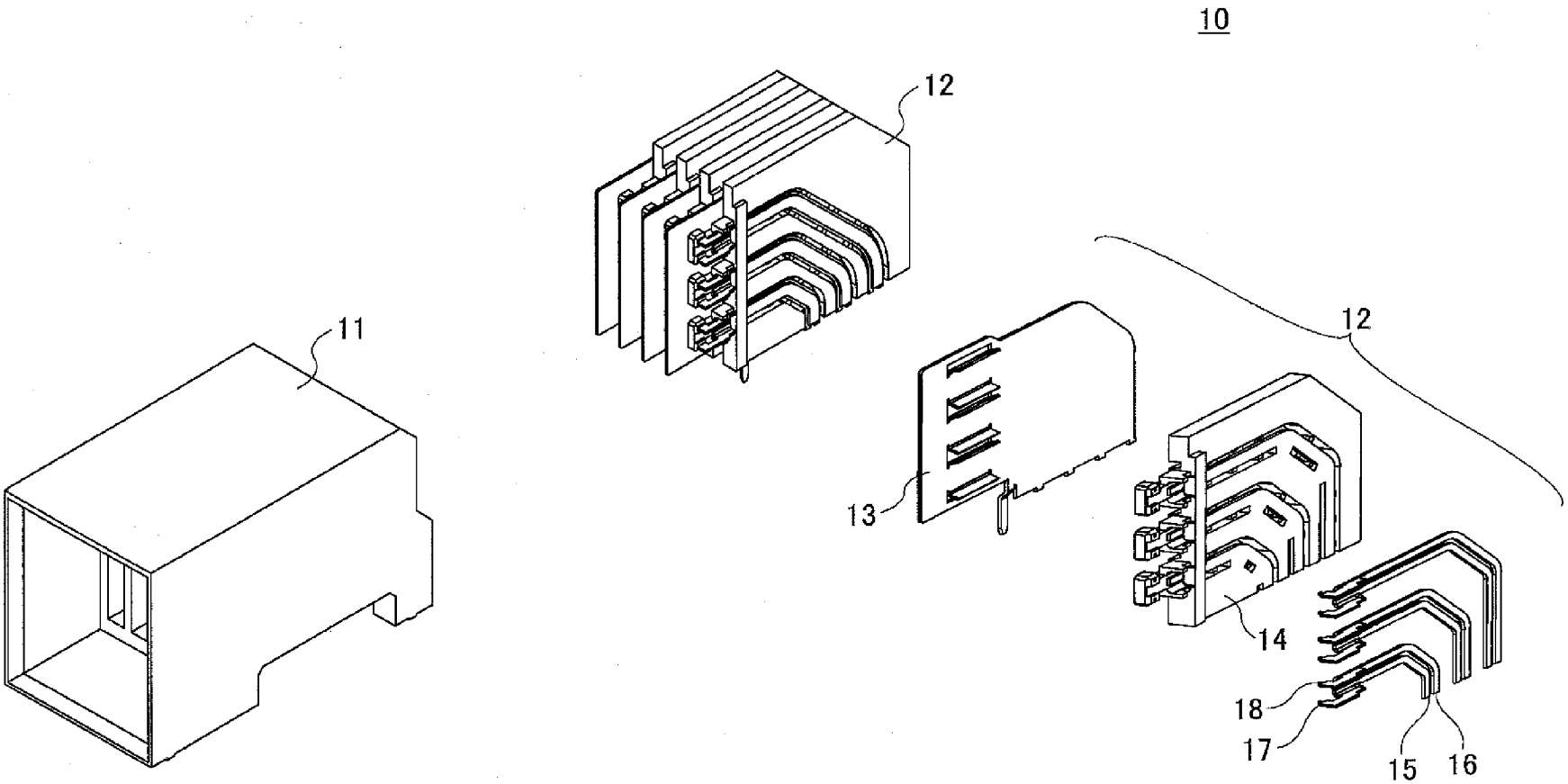
FIG. 2 is an exploded perspective view of the plug electronic connector of the First Embodiment.

Referring to FIG. 2, the plug electronic connector 10 includes a housing 11 and plural plug units 12. The plug units 12 include a grounding part (a GND part) 13 formed by a metallic plate made of a metallic material such as copper, an insulating part 14 made of a resin or the like, and plural plug terminal parts 15 and 16 to be electrode terminals, respectively. The two plug terminal parts 15 and 16 are paired and the plug terminal parts 15 and 16 can transmit different electric signals. Referring to FIG. 2, three pairs of the plug terminal parts 15 and 16 are illustrated as an example.

The GND part 13 and the plug terminal parts 15 and 16 are insulated by the insulating part 14. Ends of the plug terminal parts 15 and 16 on one side of the plug terminal parts 15 and 16 include plug terminal connecting parts 17 and 18 formed like single rods. The plug terminal connecting parts 17 and 18 are connected to jack terminal parts to be described later. The plug terminal connecting parts 17 and 18 are formed by bending parts of the plug terminal parts 15 and 16 substantially in vertical directions relative to a surface where the GND part 13 is formed. The other ends of the plug terminal parts 15 and 16 have electrode terminals (not illustrated) and are connected to a substrate (not illustrated).

(Jack Electronic Connector)

Figure 3:
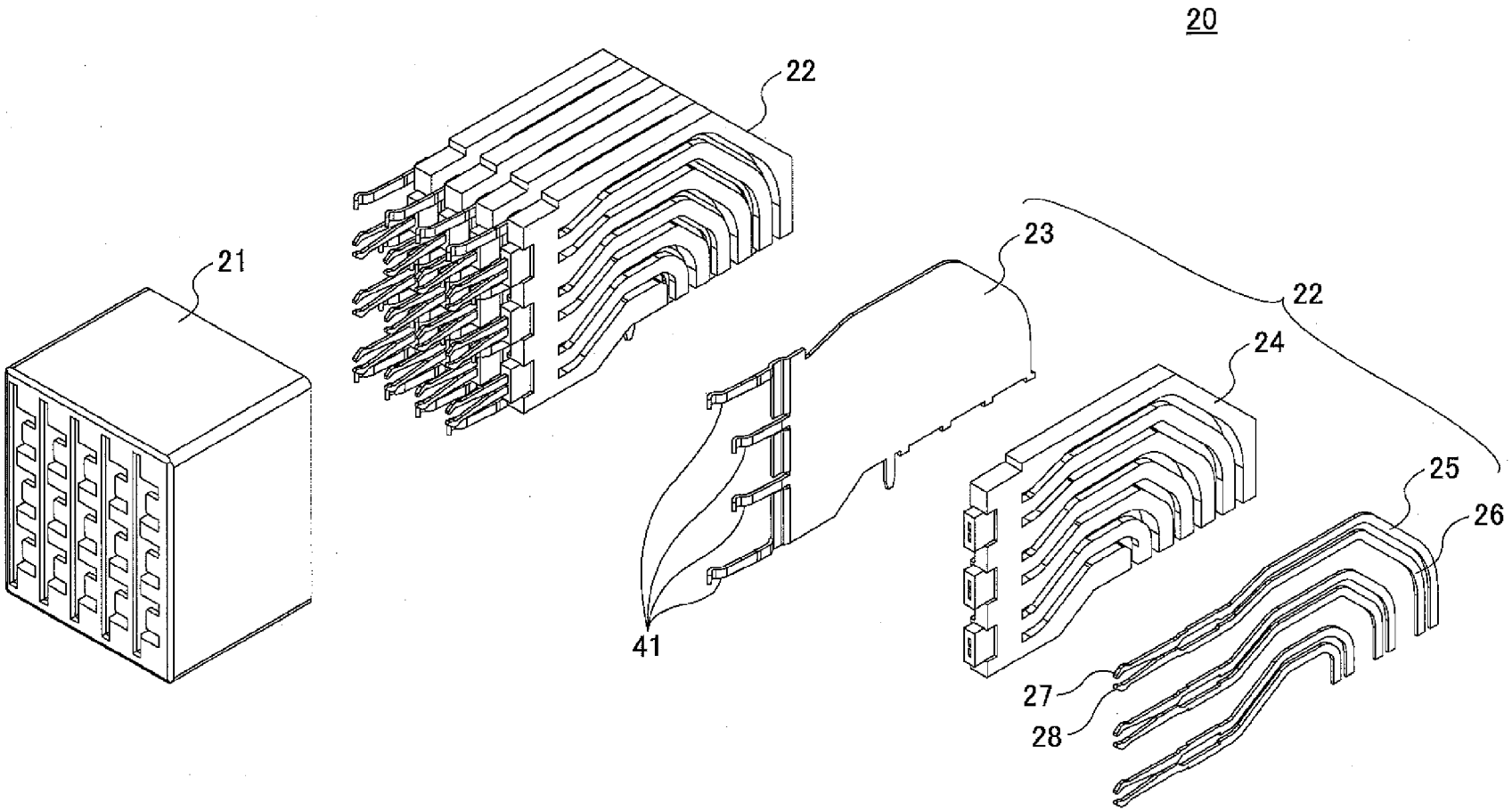
FIG. 3 is an exploded perspective view of the jack electronic connector of the First Embodiment.

Referring to FIG. 3, the jack electronic connector 20 includes a housing 21 and plural jack units. The jack unit 22 includes a GND part 23 made of a metallic plate, an insulating part 24 made of a resin material, and plural jack terminal parts 25 and 26. The plug terminal parts 25 and 26 are paired and can transmit different electric signals. Referring to FIG. 3, three pairs of the plug terminal parts 25 and 26 are illustrated as an example.

The GND part 23 and the jack terminal parts 25 and 26 are insulated by the insulating part 24. The jack terminal parts 25 and 26 have jack terminal connecting parts 27 and 28 shaped like single rods. When the plug electronic connector 10 and the jack electronic connector 20 are connected, the jack terminal connecting parts 27 and 28 are electrically connected to the plug terminal connecting part 17 and 18 of the plug terminal parts 15 and 16, respectively. The other ends of the jack terminal parts 25 and 26 have electrode terminals (not illustrated) and are connected to a substrate (not illustrated).

(Plug Unit)

Figure 4:
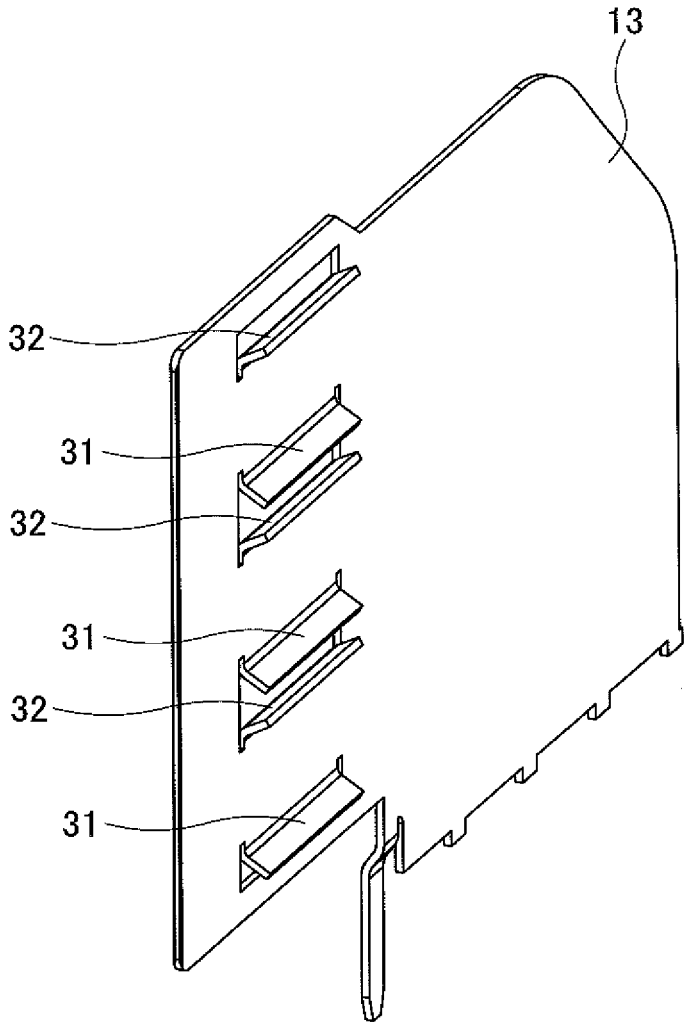
FIG. 4 is a perspective view of a grounding part of a plug unit of the First Embodiment.

Referring to FIG. 4, the GND part 13 of the plug unit 12 is described further in detail. In the electronic connector of First Embodiment, the GND part 13 is made of the metallic plate. The GND part 13 has plural pull-up parts 31 and 32 which are protrusions formed by cutting and bending parts of the surface of the GND part 13. The pull-up parts 31 and 32 may be formed by cutting and bending parts of the GND parts 13.

The pull-up parts 31 and 32 are positioned on both sides of the paired plug terminal connecting parts 17 and 18. Therefore, it is possible to block off noises from the plug terminal connecting parts 17 and 18 connected to the jack terminal connecting part 28.

Figure 5:
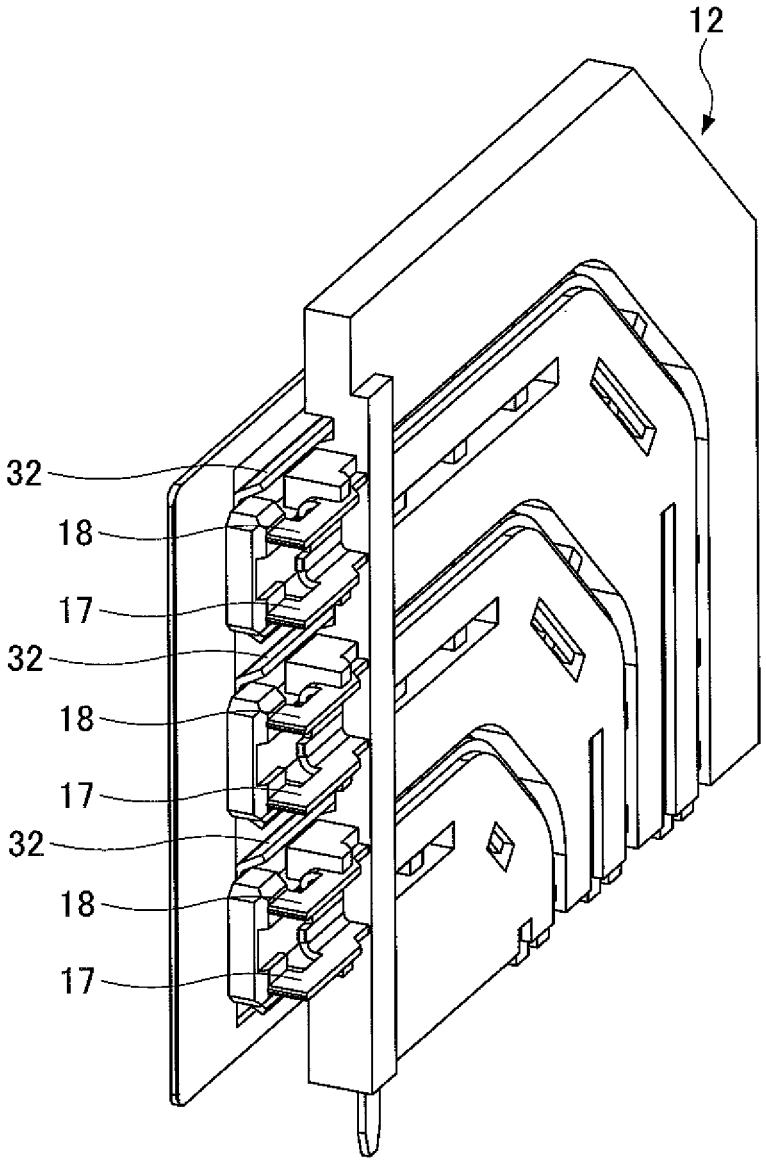
FIG. 5 is a perspective view (1) of the plug unit of the First Embodiment.
Figure 6:
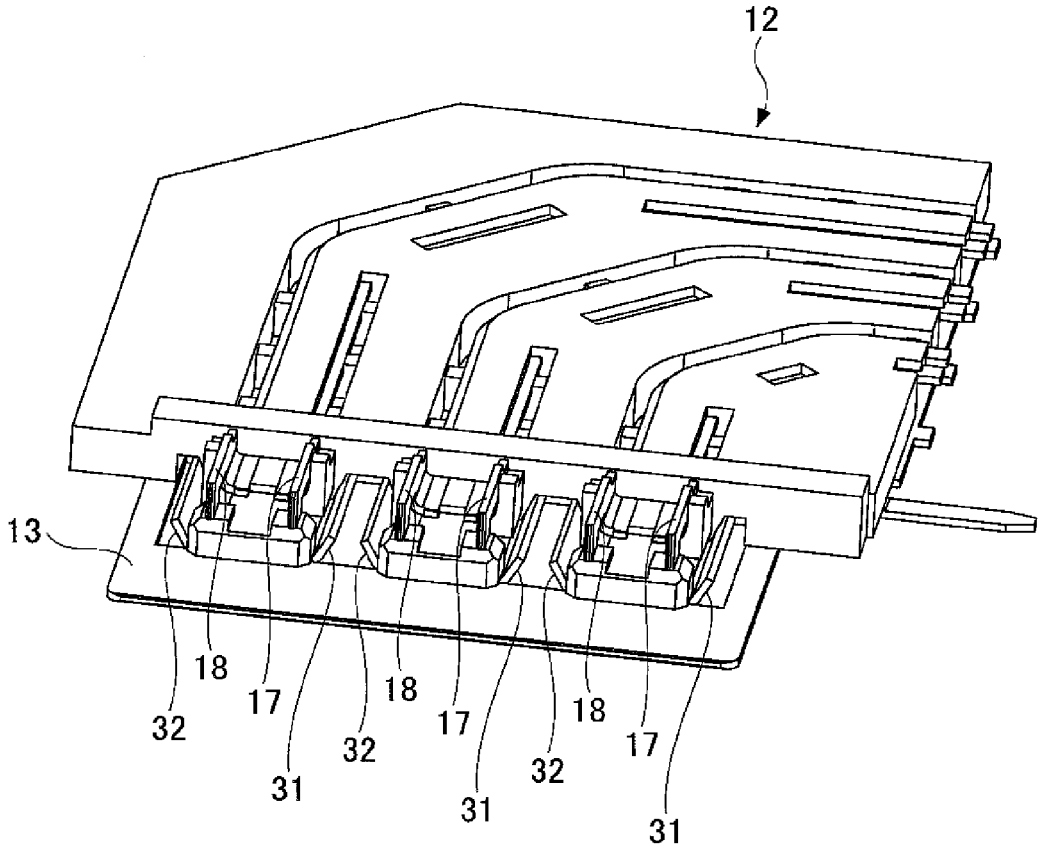
FIG. 6 is a perspective view (2) of the plug unit of the First Embodiment.
Figure 7:
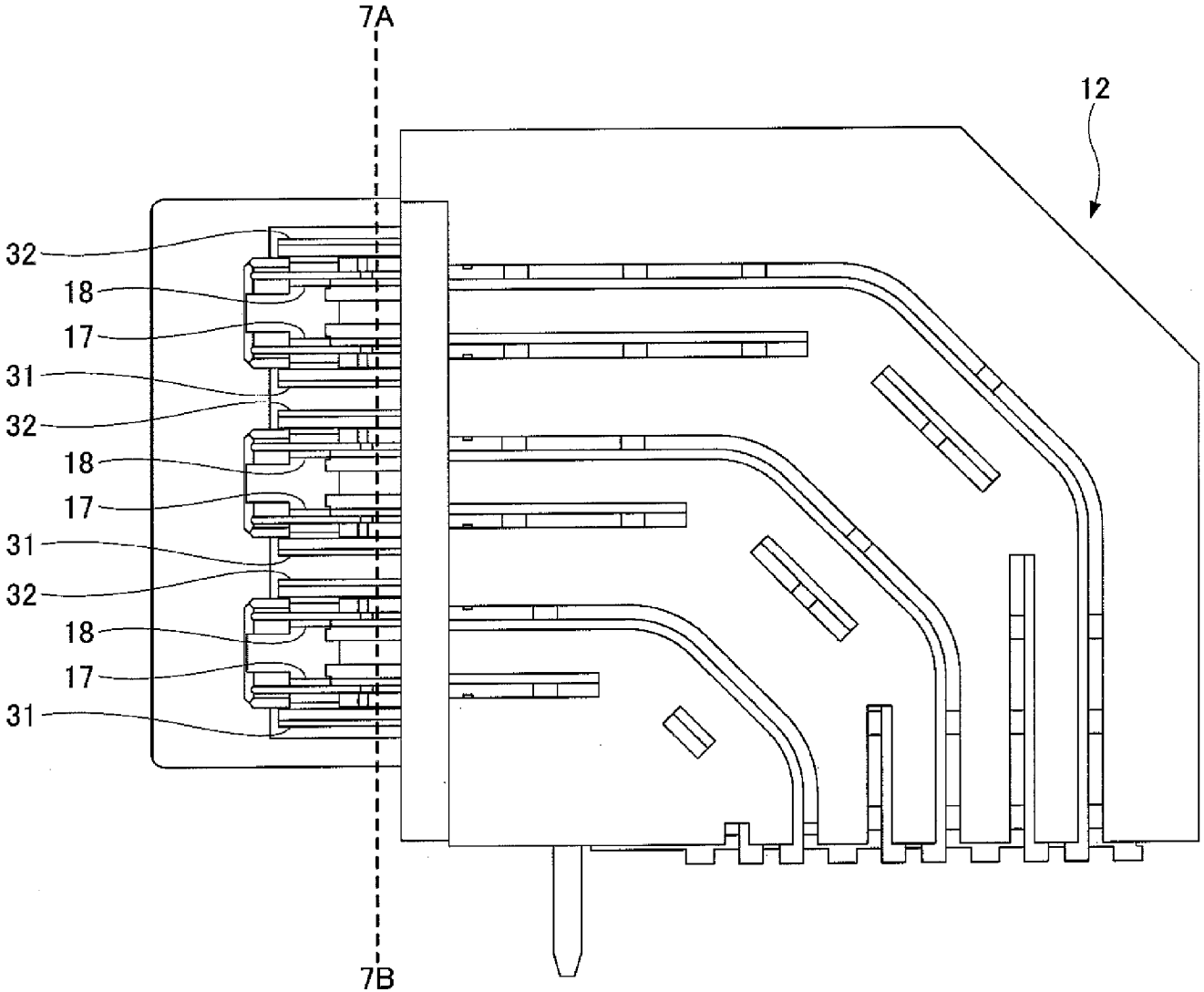
FIG. 7 is a plan view of the plug unit of the First Embodiment.
Figure 8:
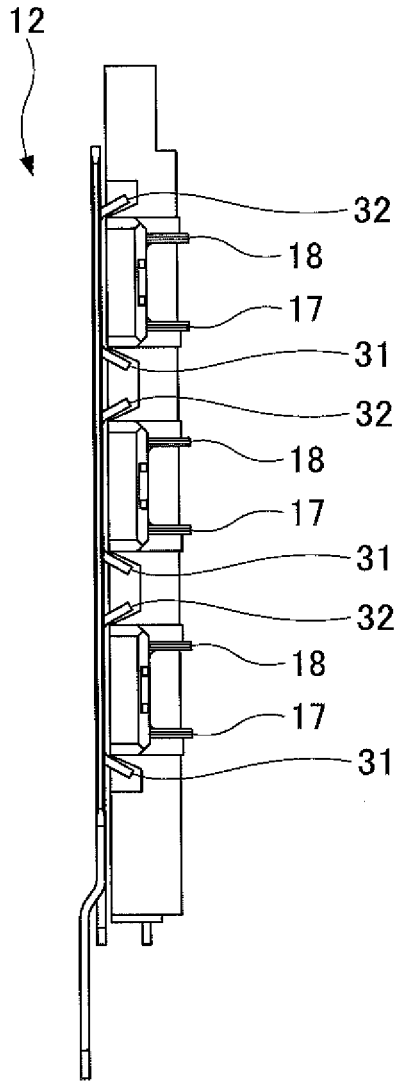
FIG. 8 is a side view of the plug unit of the First Embodiment.
Figure 9:
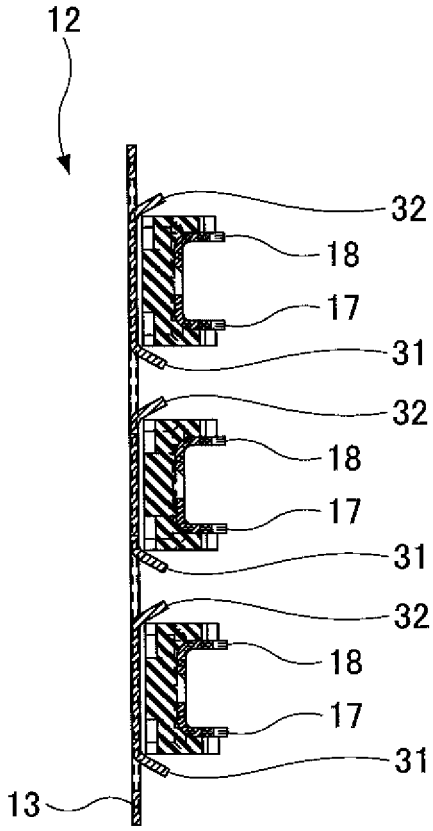
FIG. 9 is a cross-sectional view of the plug unit of the First Embodiment.
Figure 10:
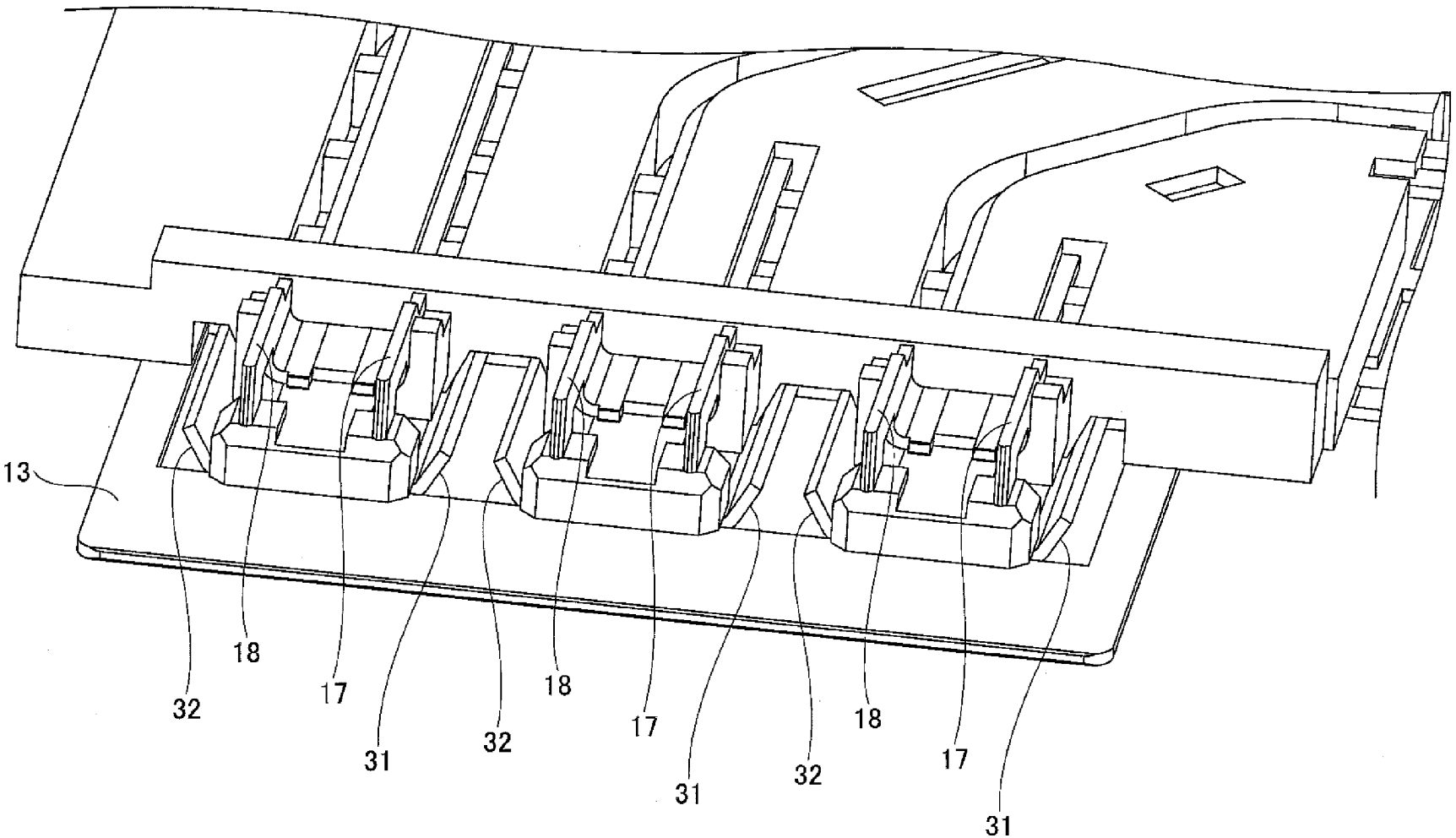
FIG. 10 is an enlarged view of the plug unit of the First Embodiment.

Referring to FIG. 5 to FIG. 9, a method of blocking off noises from the plug terminal connecting parts connected to the jack terminal connecting part is described. FIG. 5 and FIG. 6 are perspective views of the plug units 12 of the electric connector of First Embodiment of the present invention. FIG. 7 is a plan view of the plug unit 12. FIG. 8 is a side view of the plug unit 12 viewing on a connecting side. FIG. 9 is a cross-sectional view taken along a broken line 7A-7B. FIG. 10 is enlarged view of plug terminal connecting parts 17 and 18 illustrated in FIG. 6.

The plug terminal connecting parts 17 and 18 are arranged along an outward extending direction of the GND part 13. A distance between the plug terminal connecting part 17 of paired plug terminal connecting parts 17 and 18 and the plug terminal connecting part 18 of the adjacent paired plug terminal connecting parts 17 and 18 is made small in consideration of high integration. Said differently, adjacent pairs of the plug terminal connecting parts 17 and 18 are proximally arranged. According to a First Embodiment, the pull-up parts 31 and 32 are provided between the adjacent pairs of the plug terminal connecting parts 17 and 18. Electro-magnetic waves generated in transmitting an electric signal to any one of the plug terminal connecting parts 17 and 18 can be prevented from affecting the adjacent plug terminal connecting part 17 or 18 of the adjacent pair of the plug terminal connecting parts 17 and 18 adjacent to the any one of the plug terminal connecting parts 17 and 18. Said differently, it is assumed that a part of the electromagnetic waves generated in the plug terminal connecting part 17 and 18 is absorbed by the pull-up part 31 or 32 formed in the vicinity of the plug terminal connecting part 17 or 18 to thereby reduce noise. To achieve this, it is preferable to make the lengths of the pull-up parts 31 and 32 long.

Further, it is preferable to make a distance between the pull-up part for a pair of plug terminal connecting parts 17 and 18 and the adjacent pull-up part adjacent to the pull-up part for the adjacent pair of plug terminal connecting parts 17 and 18 adjacent to the air of plug terminal connecting parts 17 and 18 shorter than a distance between the pair of plug terminal connecting parts 17 and 18 and the adjacent pair of plug terminal connecting parts 17 and 18. The noise reduction is assumed because a part of the electromagnetic waves generated by the plug terminal connecting parts 17 and 18 and the like may be absorbed by the pull-up parts 31 and 32.

(Connection of Electronic Connector)

Figure 11:
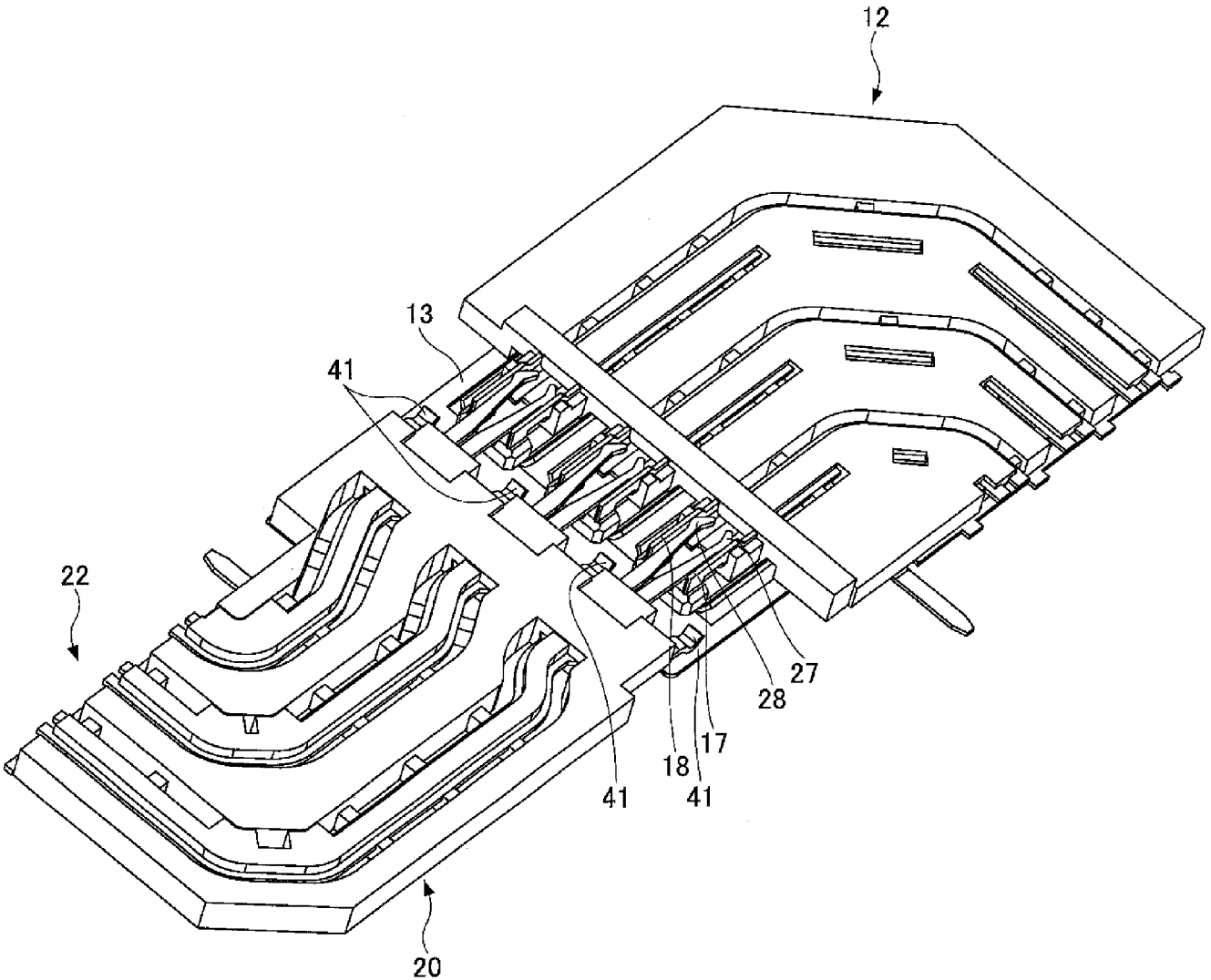
FIG. 11 is a perspective view of the electronic connector of the First Embodiment under a connected state.
Figure 12:
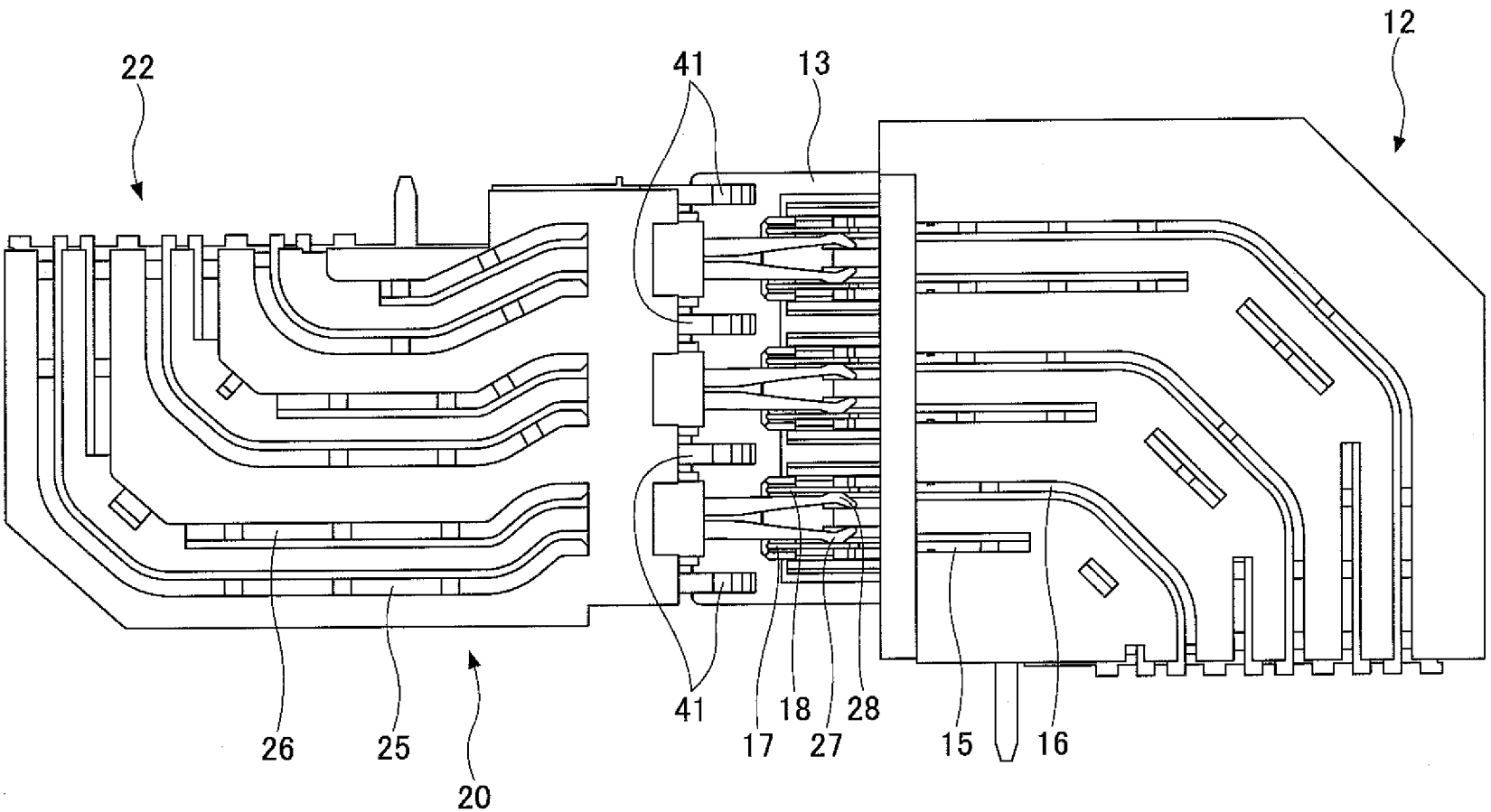
FIG. 12 is a plan view of the electronic connector of the First Embodiment under the connected state.
Figure 13:
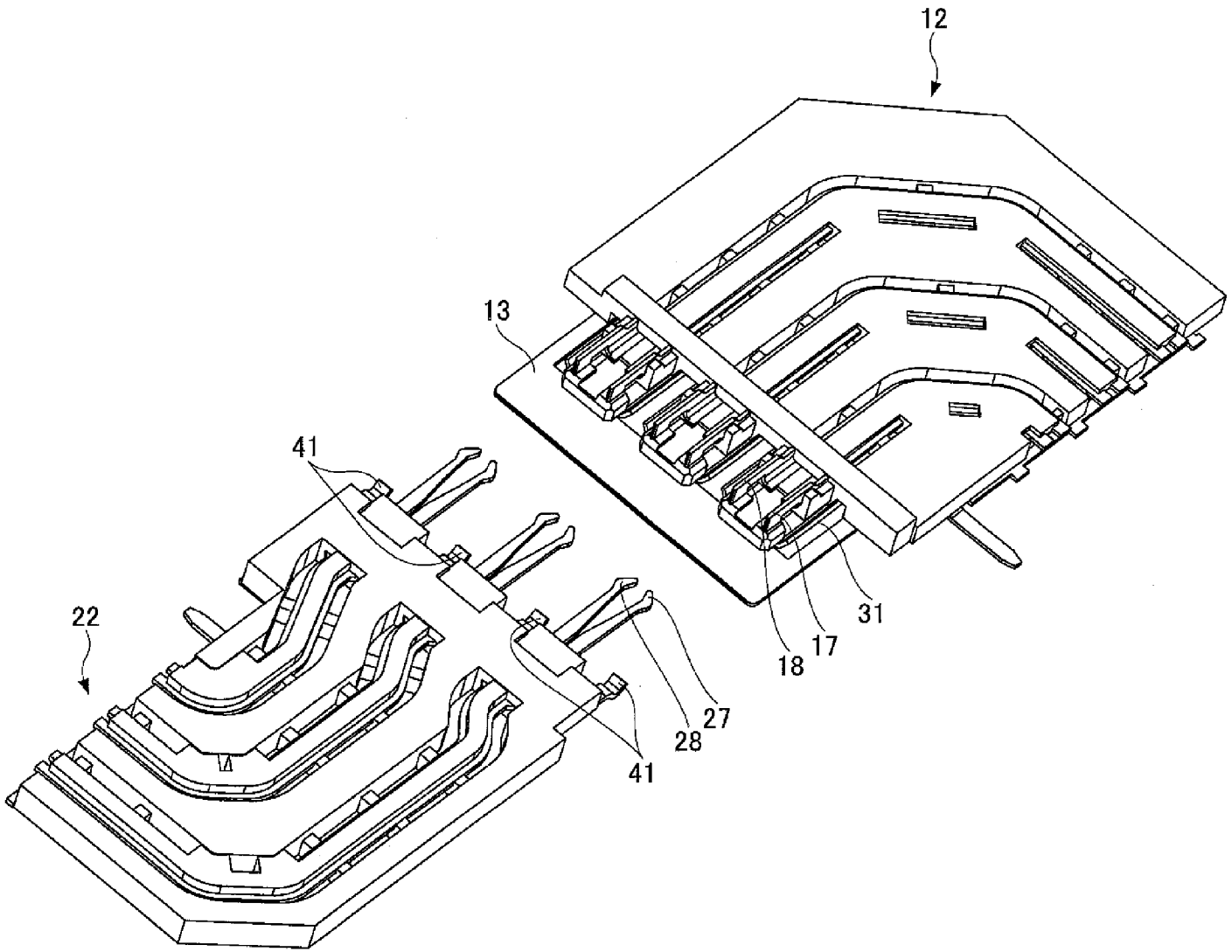
FIG. 13 is a perspective view of the electronic connector of the First Embodiment under an unconnected state.
Figure 14:
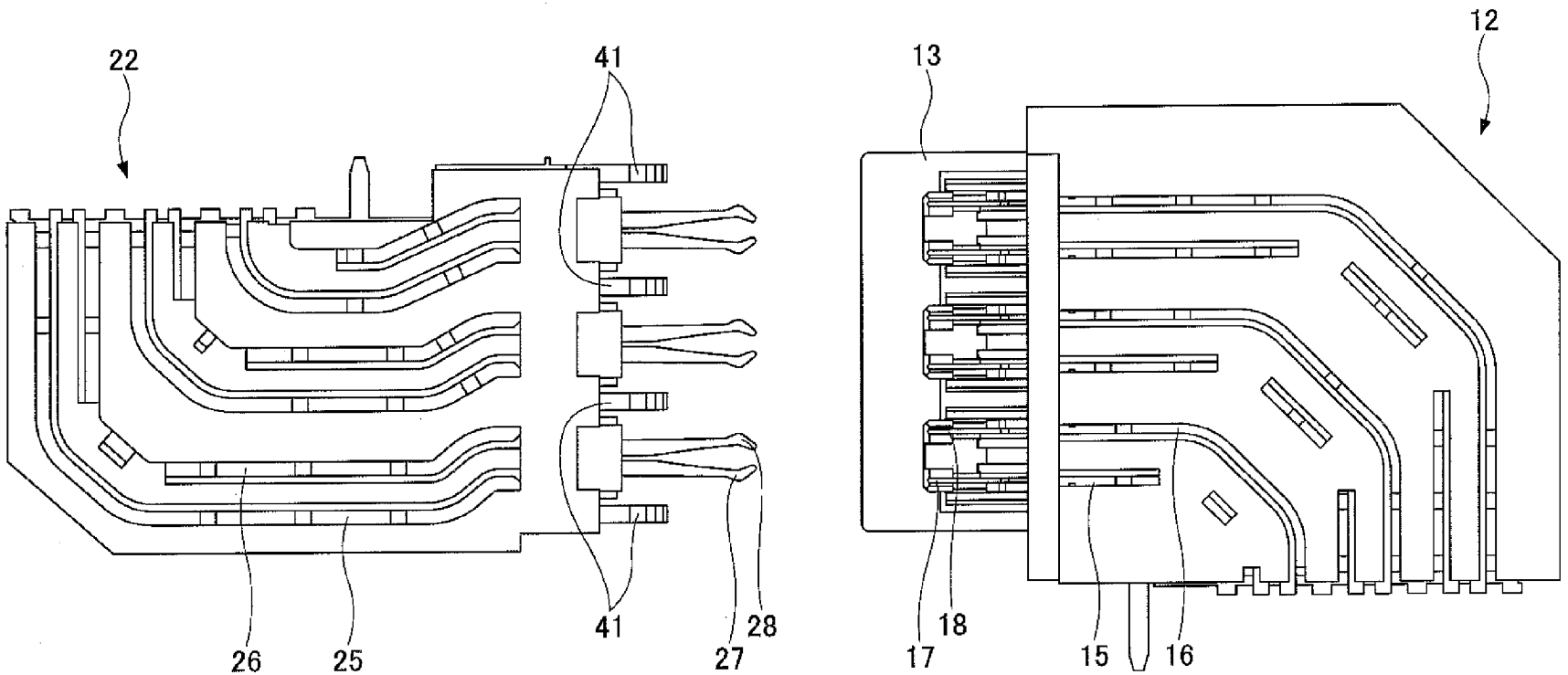
FIG. 14 is a plan view of the electronic connector of the First Embodiment under the unconnected state.

FIG. 11 and FIG. 12 illustrate the plug unit 12 and the jack unit 22 under a connected state between the plug electronic connector 10 and the jack electronic connector 20. FIG. 11 is a perspective view of the connected state between the plug electronic connector 10 and the jack electronic connector 20, and FIG. 12 is a plan view of the connecting state between the plug electronic connector 10 and the jack electronic connector 20. FIG. 13 and FIG. 14 illustrate the plug unit 12 and the jack unit 22 under an unconnected state between the plug electronic connector 10 and the jack electronic connector 20. FIG. 13 is a perspective view of the unconnected state between the plug electronic connector 10 and the jack electronic connector 20, and FIG. 14 is a plan view of the unconnected state between the plug electronic connector 10 and the jack electronic connector 20.

Referring to FIG. 3 and FIG. 12 to FIG. 14, the GND part 23 provided in the jack unit 22 includes a plate-like GND main body 30 and four GND terminals 41 connected to the GND main body 30. The lengths of the GND terminals 41 are determined based on the lengths and shapes of the pull-up parts 31 and 32 formed in the GND part 13. Said differently, if the pull-up parts 31 and 32 are long in the connecting direction of the electronic connector, the lengths of the GND terminals 41 may be instead short.

Figure 15:
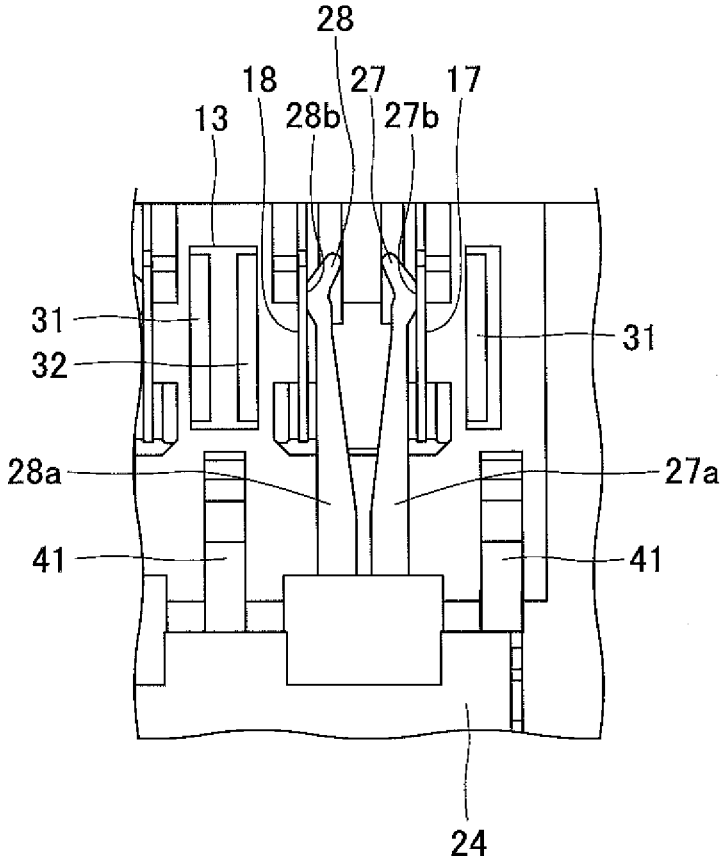
FIG. 15 is an enlarged view of a part of the electronic connector of the First Embodiment under the connected state.

FIG. 15 is an enlarged view of a connected portion between the plug unit 12 and the jack unit 22 under the connected state between the plug electronic connector 10 and the jack electronic connector 20. When the plug electronic connector 10 is connected to the jack electronic connector 20, the jack terminal connecting part 27 of the jack electronic connector 20 is in contact with the plug terminal connecting part 17 of the plug electronic connector 10 at a contact point part 27*b* of the jack terminal connecting part 27, and the jack terminal connecting part 28 of the jack electronic connector 20 is in contact with the plug terminal connecting part 18 of the plug electronic connector 10 at a contact point part 28*b* of the jack terminal connecting part 28.

As described, the jack terminal connecting parts 27 and 28 are paired. A distance between the contact point parts 27*b* and 28*b* is apt to be long with an outwardly spreading spring force (biasing). When the plug electronic connector 10 is connected to the jack electronic connector 20, the bar-like parts 27*a* and 28*a* of the jack terminal connecting parts 27 and 28 are outwardly biased with a property of spring of the bar-like parts 27*a* and 28*a*. In the outwardly spreading (biasing) direction, surfaces of the plug terminal connecting parts 17 and 18 of the plug electronic connector 10 are formed to face each other. With the spring property of the bar-like parts 27*a* and 28*a*, the jack terminal connecting parts 27 and 28 are biased in directions of pushing the contact point parts 27*b* and 28*b* against the plug terminal connecting parts 17 and 18, respectively. Said differently, the plug terminal connecting parts 17 and 18 face each other. The jack terminal connecting parts 27 and 28 are biased in directions of pushing the plug terminal connecting parts 17 and 18 at the contact point parts 27*b* and 28*b*. With this, the connections between the plug terminal connecting parts 17 and 18 and the jack terminal connecting parts 27 and 28 are maintained.

When the plug electronic connector 10 and the jack electronic connector 20 are connected, jack terminal connecting parts 27 and 28 of the jack electronic connector 20 are relatively moved along the connecting direction of the GND part 13 of the plug electronic connector 10. Said differently, the jack terminal connecting parts 27 and 28 are moved substantially in parallel to the plate-like GND part 13 of the plug electronic connector 10 in connecting the plug electronic connector 10 to the jack electronic connector 20. With this, the distance between the jack terminal connecting part 27 and the GND part 13 and the distance between the jack terminal connecting part 28 and the GND part 13 are constantly maintained in connecting the plug electronic connector 10 to the jack electronic connector 20.

With the electronic connector of First Embodiment, the pull-up parts 31 and 32 are provided in the GND part 13 of the plug unit 12 in the vicinity of the connecting portions between the plug terminal connecting parts 17 and 18 and the jack terminal connecting part 27 and 28.

(Another Example of the GND Part)

Figure 16:
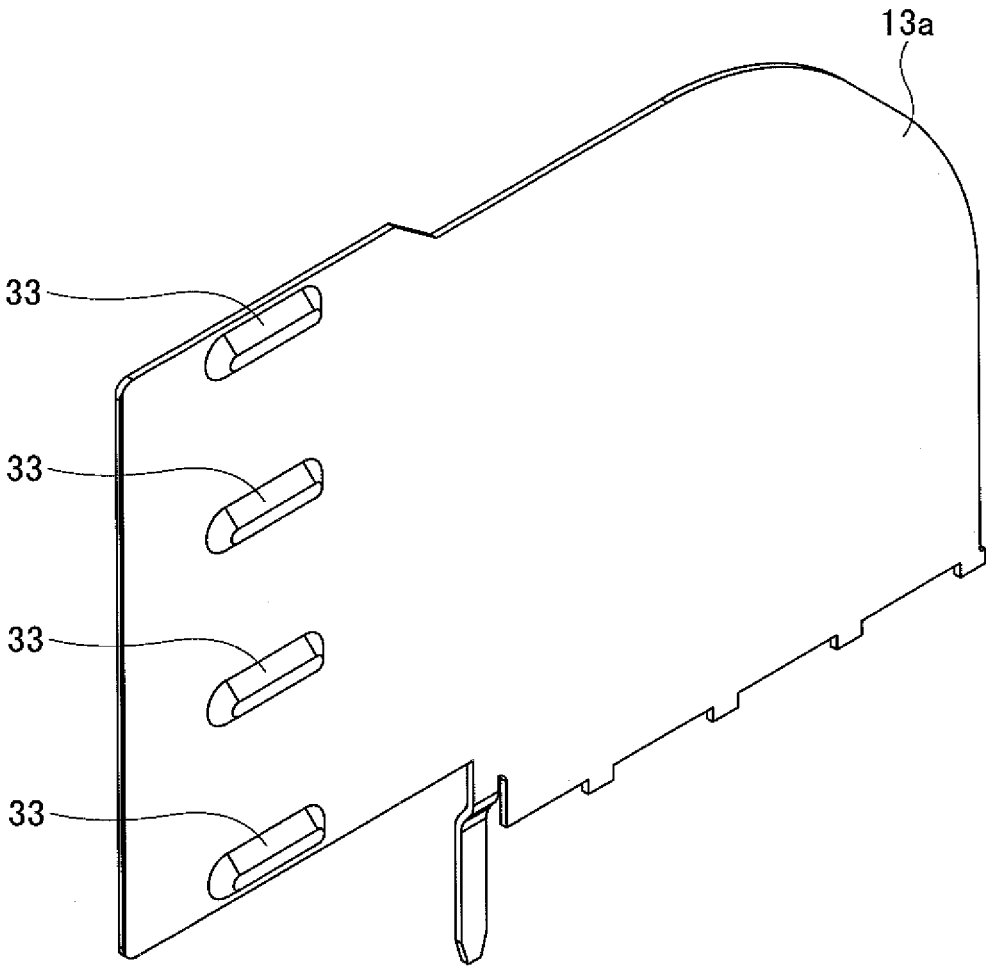
FIG. 16 is a perspective view of another grounding part of the plug connector of the First Embodiment of the present invention.

Referring to FIG. 16, another example of the GND part 13*a* of the plug unit 12 of the plug electronic connector 10 is described next. The GND part 13*a* illustrated in FIG. 16 has protrusions 33 partly protruding from the GND part 13*a*. The shape of the protrusion 33 is called a corrugation type. The protrusion 33 is formed by pushing out a portion where the protrusion 33 is formed on the GND part 13*a*. The GND part 13*a* having the protrusions 33 may be used in a similar manner to the GND part 13, and a similar effect to that of the GND part 13 is obtainable in the GND part 13*a*.

[b] Second Embodiment

Figure 17:
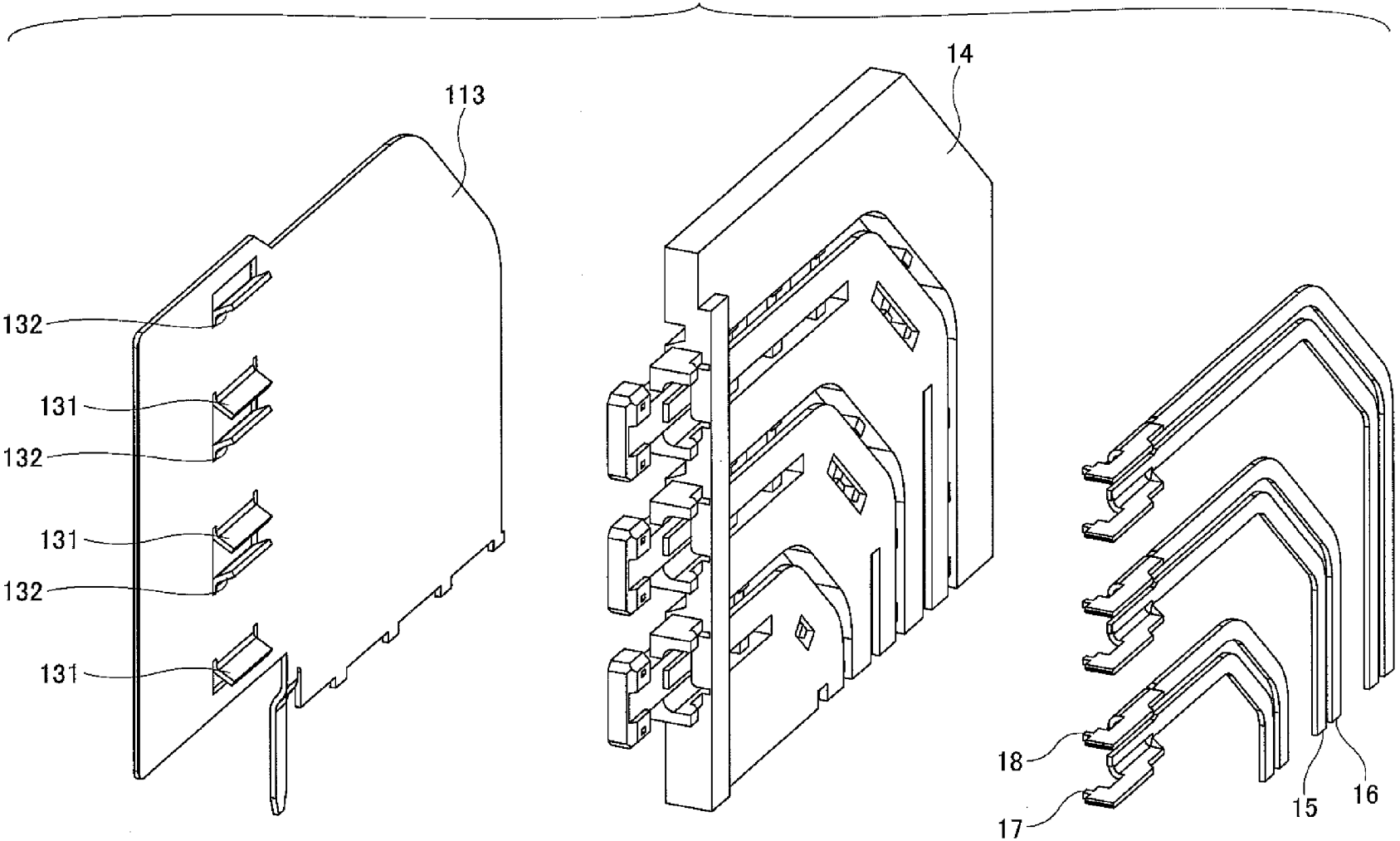
FIG. 17 is an exploded view of a plug unit of a Second Embodiment of the present invention.
Figure 18:
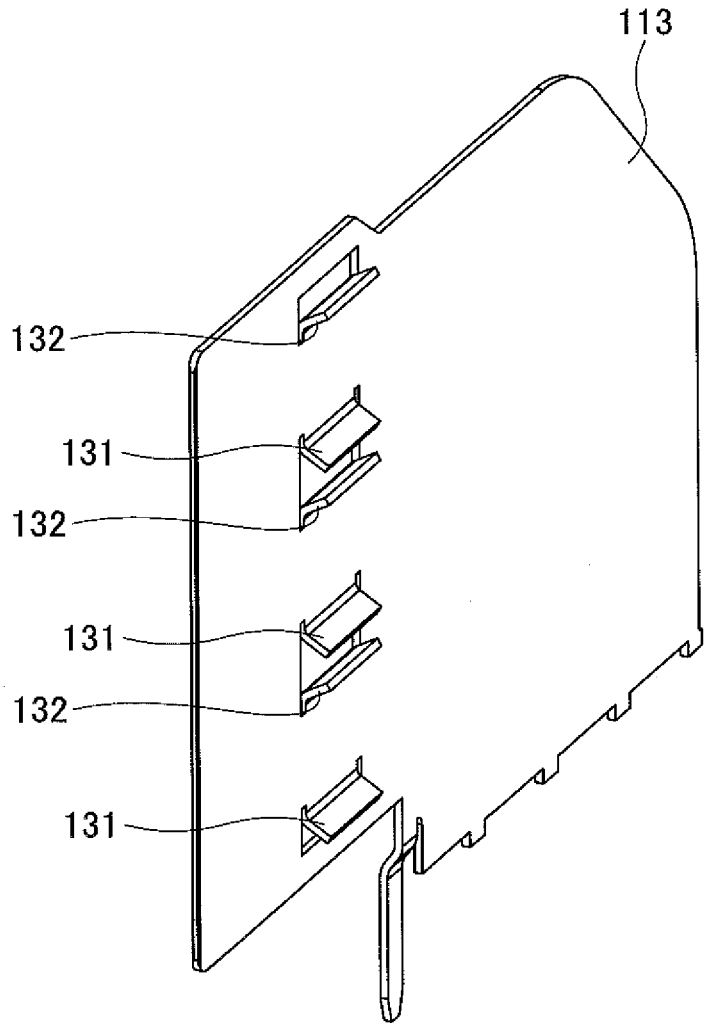
FIG. 18 is a perspective view of a grounding part of the plug unit of the Second Embodiment.
Figure 19:
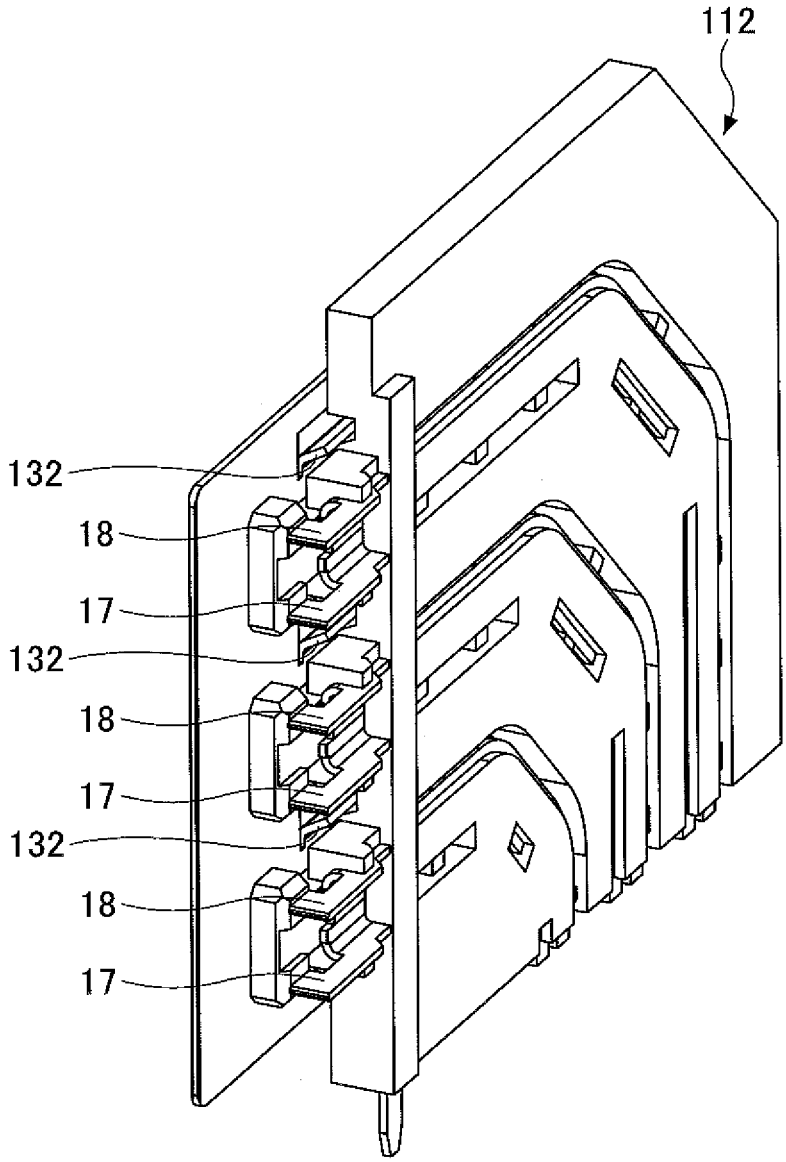
FIG. 19 is a perspective view (1) of the plug unit of the Second Embodiment.
Figure 20:
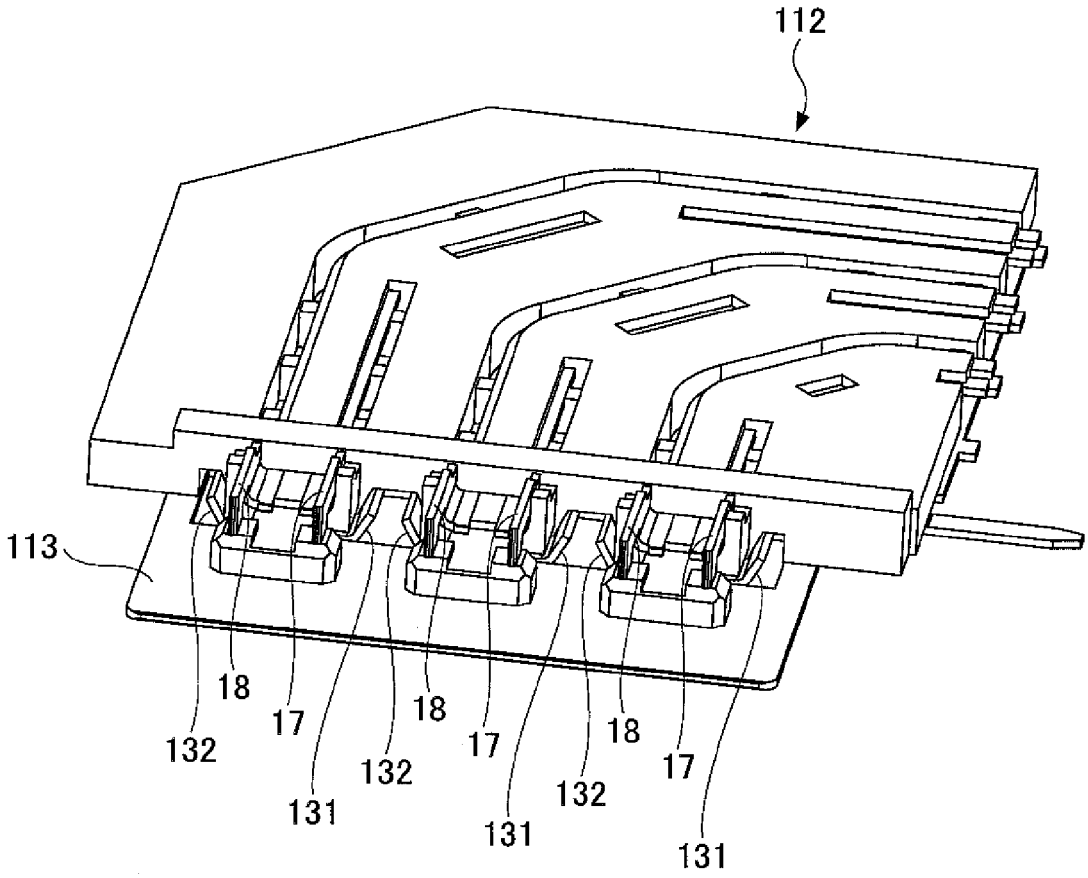
FIG. 20 is a perspective view (2) of the plug unit of the Second Embodiment.
Figure 21:
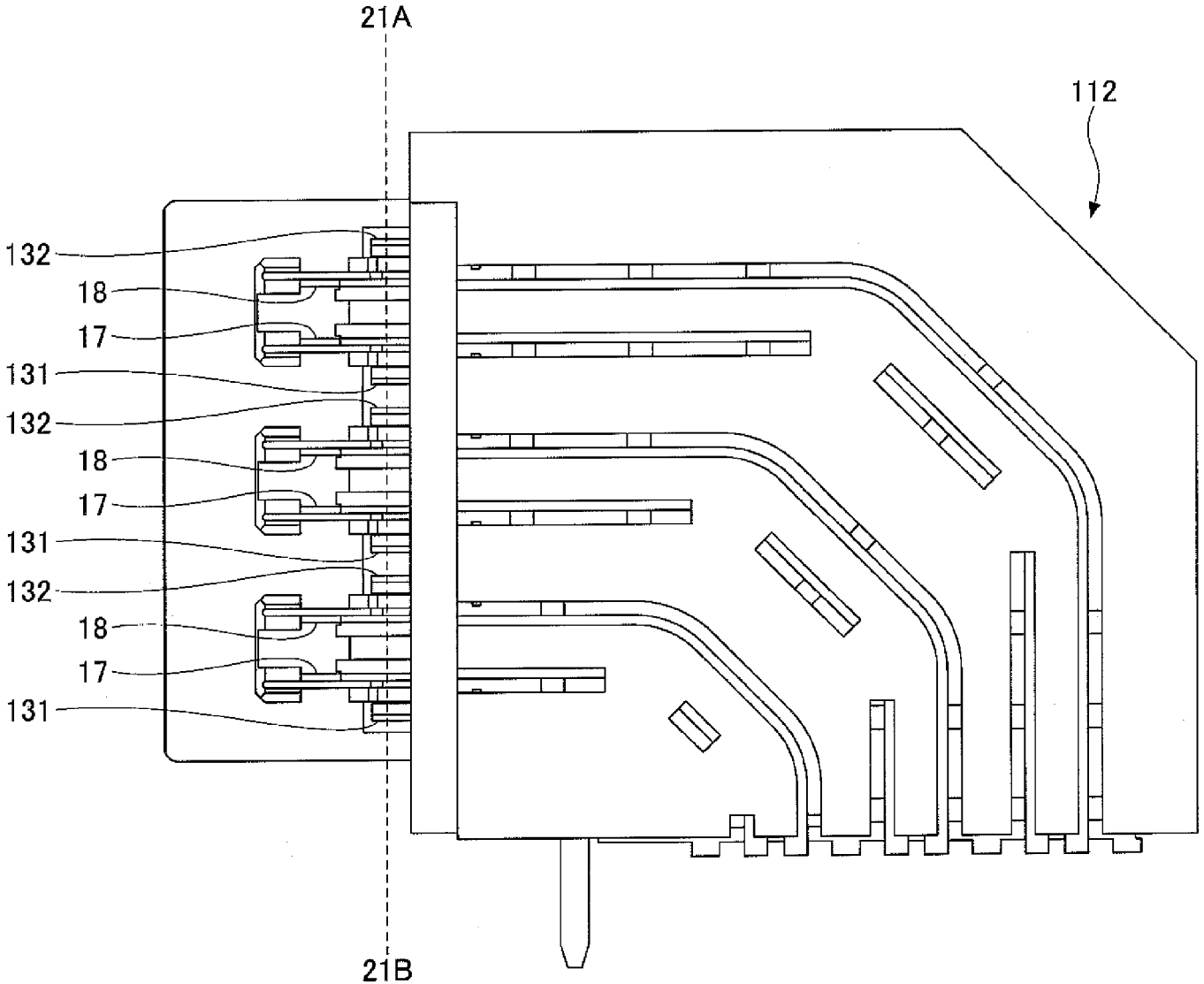
FIG. 21 is a plan view of the plug unit of the Second Embodiment.
Figure 22:
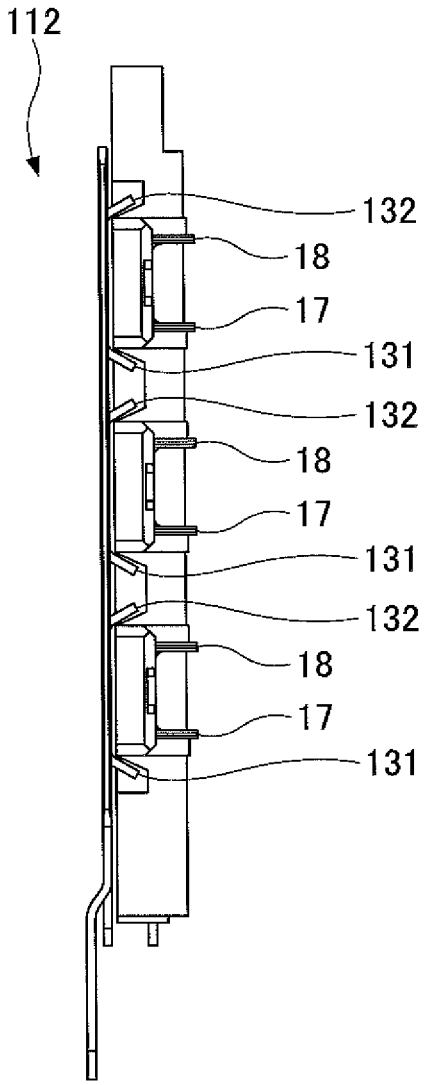
FIG. 22 is a side view of the plug unit of the Second Embodiment.
Figure 23:
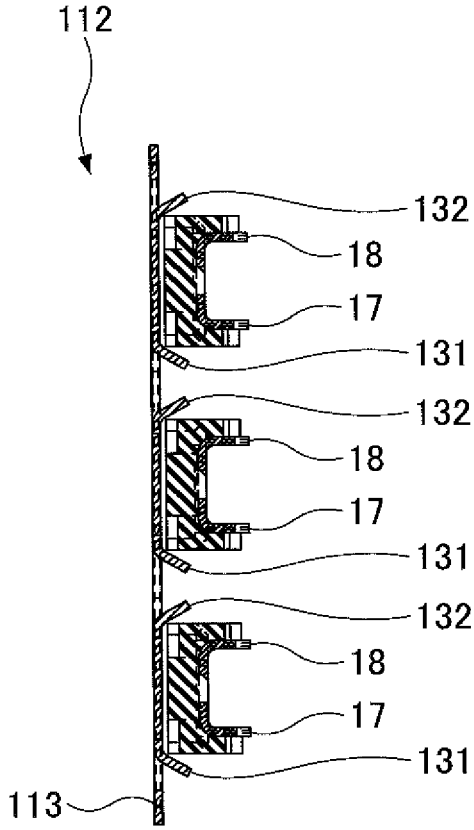
FIG. 23 is a cross-sectional view of the plug unit of the Second Embodiment.

A Second Embodiment will now be described. An electronic connector of Second Embodiment has the shape of a GND part of a plug unit different from that of First Embodiment. FIG. 17 is an exploded view of a plug unit 112 included in a plug electronic connector of the Second Embodiment. FIG. 18 is a perspective view of the GND part 113 included in the plug unit 112. FIG. 19 and FIG. 20 are perspective views of the plug unit 112 of the electronic connector of Second Embodiment. FIG. 21 is a plan view of the plug unit 112. FIG. 22 is a side view of the plug unit 112 viewed on a connecting side. FIG. 23 is a cross-sectional view of the plug unit 112 taken along a broken line 21A-21B of FIG. 21.

Figure 24:
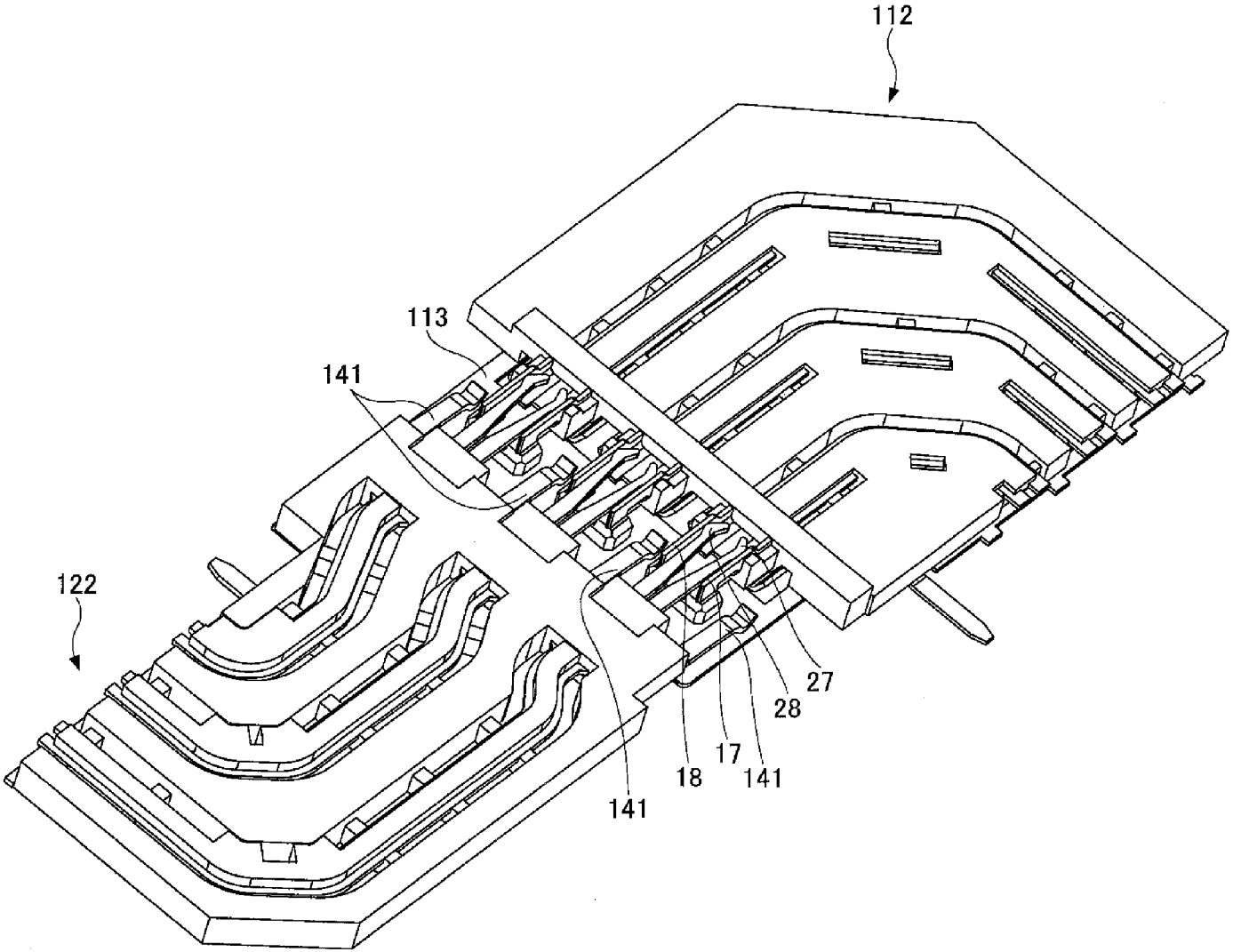
FIG. 24 is a perspective view of the electronic connector of the Second Embodiment under the connected state.
Figure 25:
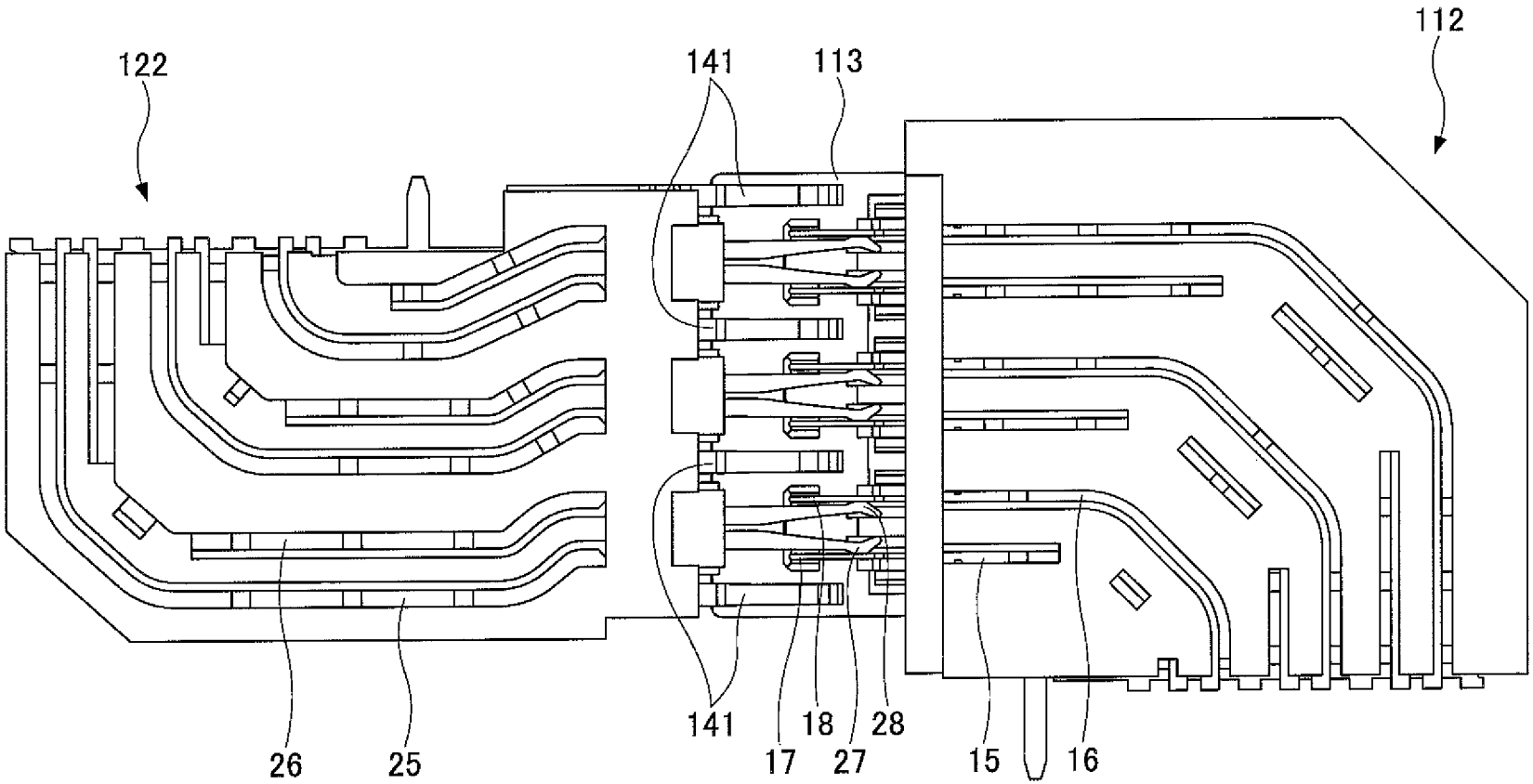
FIG. 25 is a plan view of the electronic connector of the Second Embodiment under the connected state.
Figure 26:
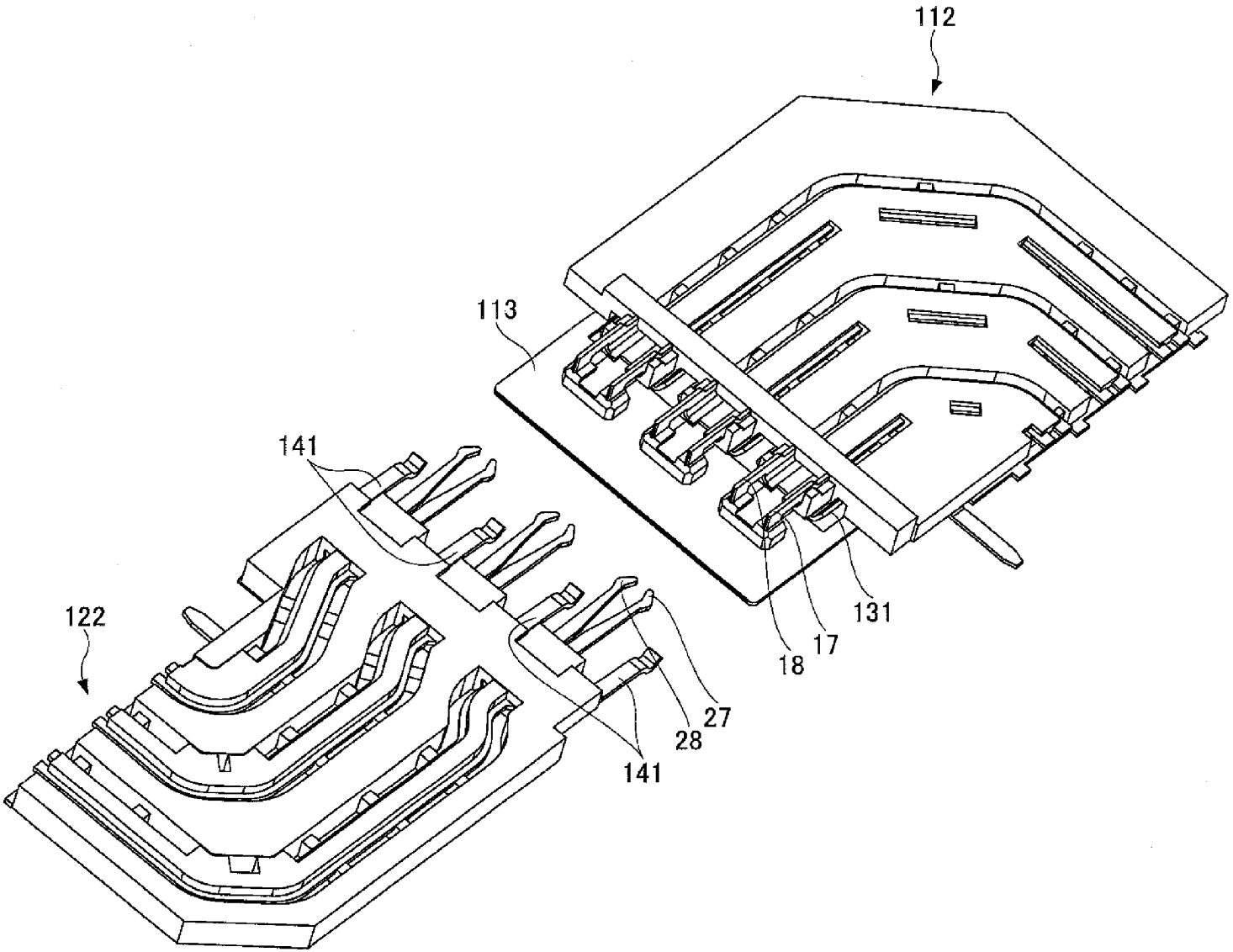
FIG. 26 is a perspective view of the electronic connector of the Second Embodiment under the unconnected state.
Figure 27:
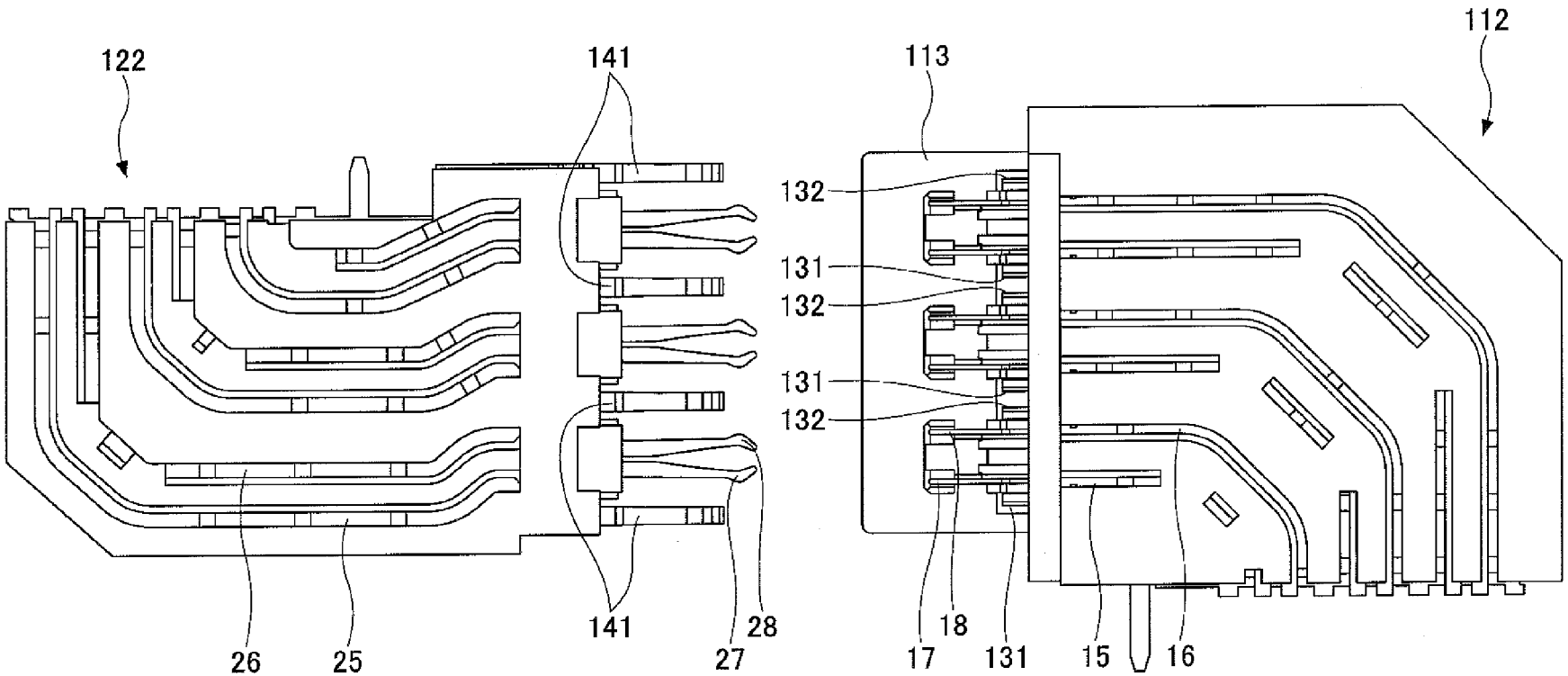
FIG. 27 is a plan view of the electronic connector of the Second Embodiment under the unconnected state.

Within the Second Embodiment, the GND part 113 has plural pull-up parts 131 and 132, which are short relative to a portion of the GND part 113 exposed from an insulating unit 14 of the plug unit 112 in a connecting direction of the electronic connector. Referring to FIGS. 24 and 27, it is possible to increase the length of the GND terminals 141 of a jack unit 122 of the jack electronic connector 20. FIG. 24 and FIG. 25 illustrate the plug unit 112 and the jack unit 122 under a connected state between the plug electronic connector 10 and the jack electronic connector 20. FIG. 24 is a perspective view of the plug unit 112 and the jack unit 122 under the connected state between the plug electronic connector and the jack electronic connector. FIG. 25 is a plan view of the plug unit 112 and the jack unit 122 under the connected state between the plug electronic connector 10 and the jack electronic connector 20. FIG. 26 and FIG. 27 illustrate the plug unit 112 and the jack unit 122 under a connected state between the plug electronic connector 10 and the jack electronic connector 20. FIG. 26 is a perspective view of the plug unit 112 and the jack unit 122 under the connected state between the plug electronic connector 10 and the jack electronic connector 20. FIG. 27 is a plan view of the plug unit 112 and the jack unit 122 under the connected state between the plug electronic connector 10 and the jack electronic connector 20.

The other portions are the same as those in the First Embodiment.

[c] Third Embodiment

Figure 28:
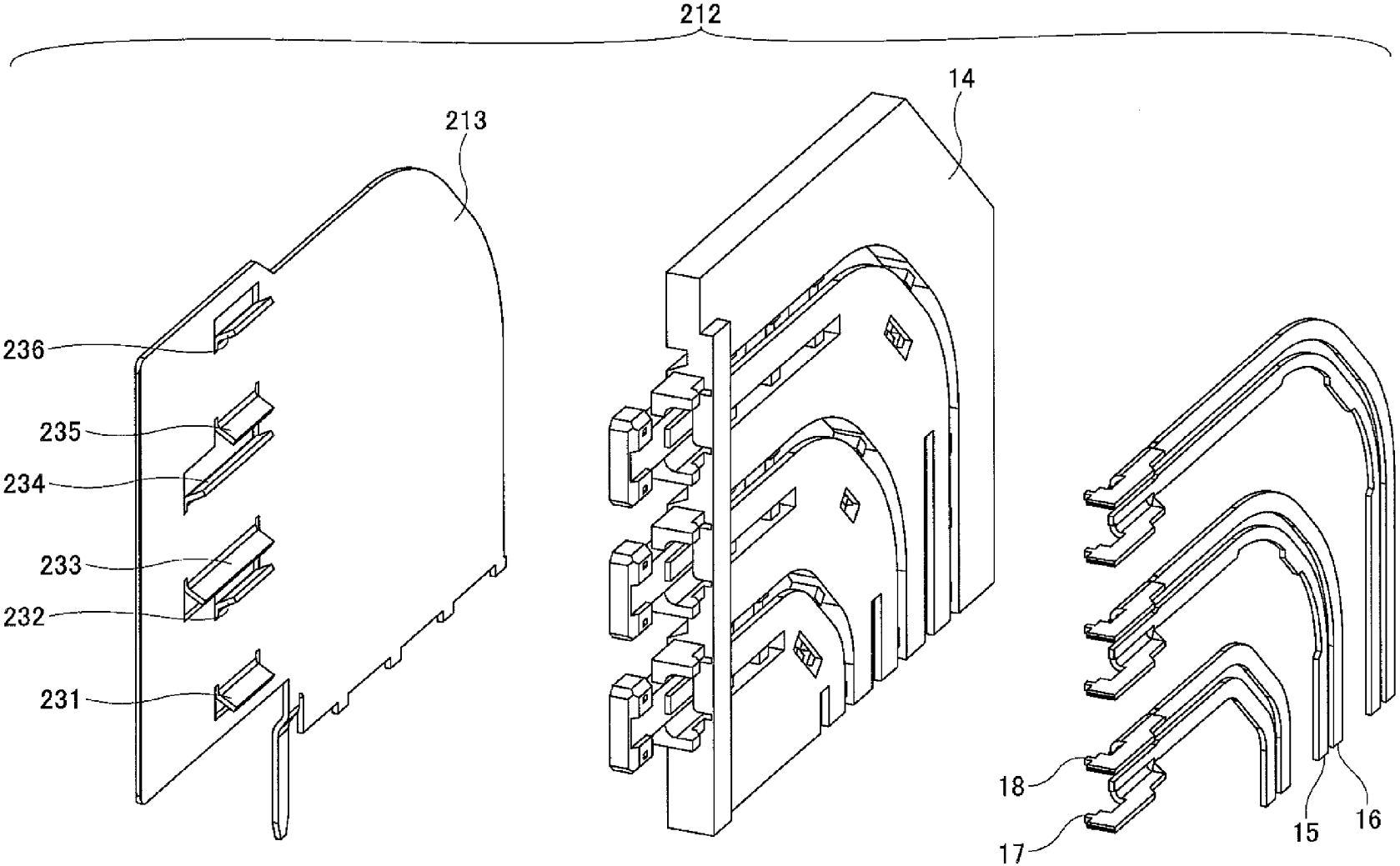
FIG. 28 is an exploded view of a plug unit of a Third Embodiment of the present invention.
Figure 29:
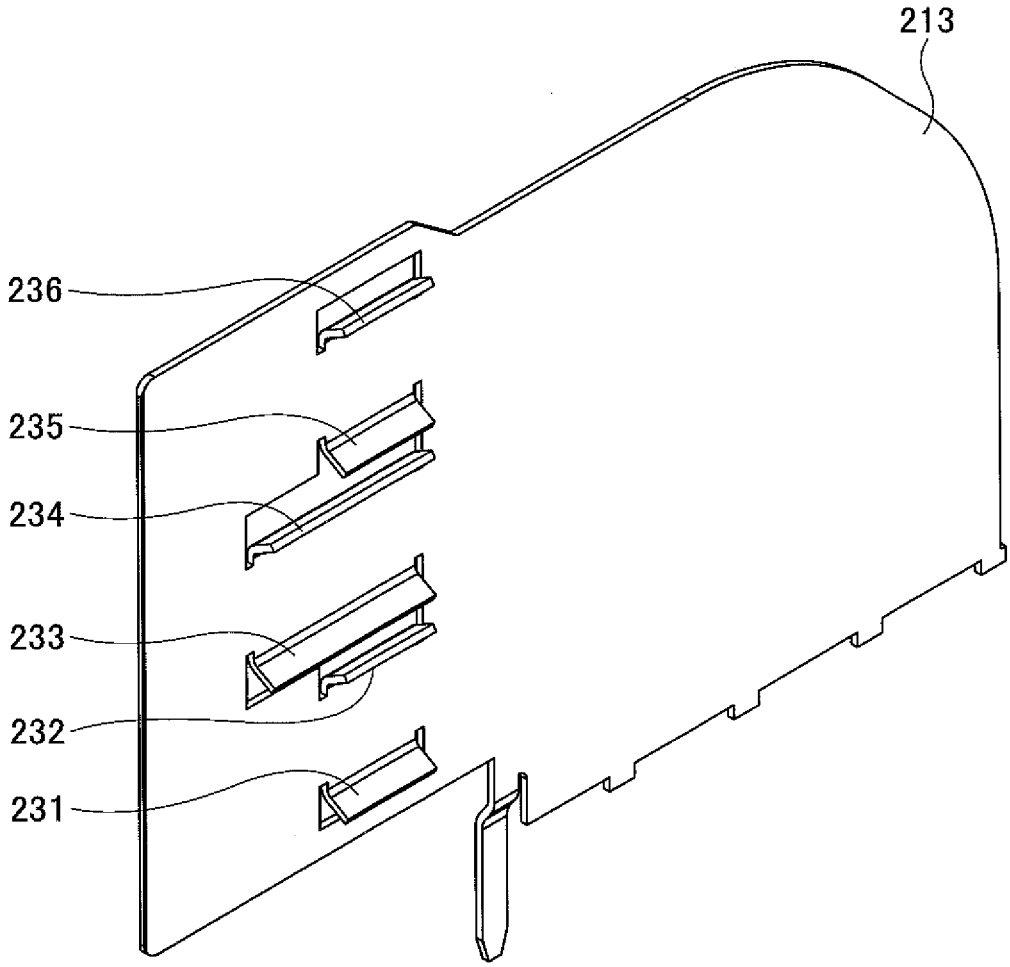
FIG. 29 is a perspective view of a grounding part of the plug unit of the Third Embodiment.
Figure 30:
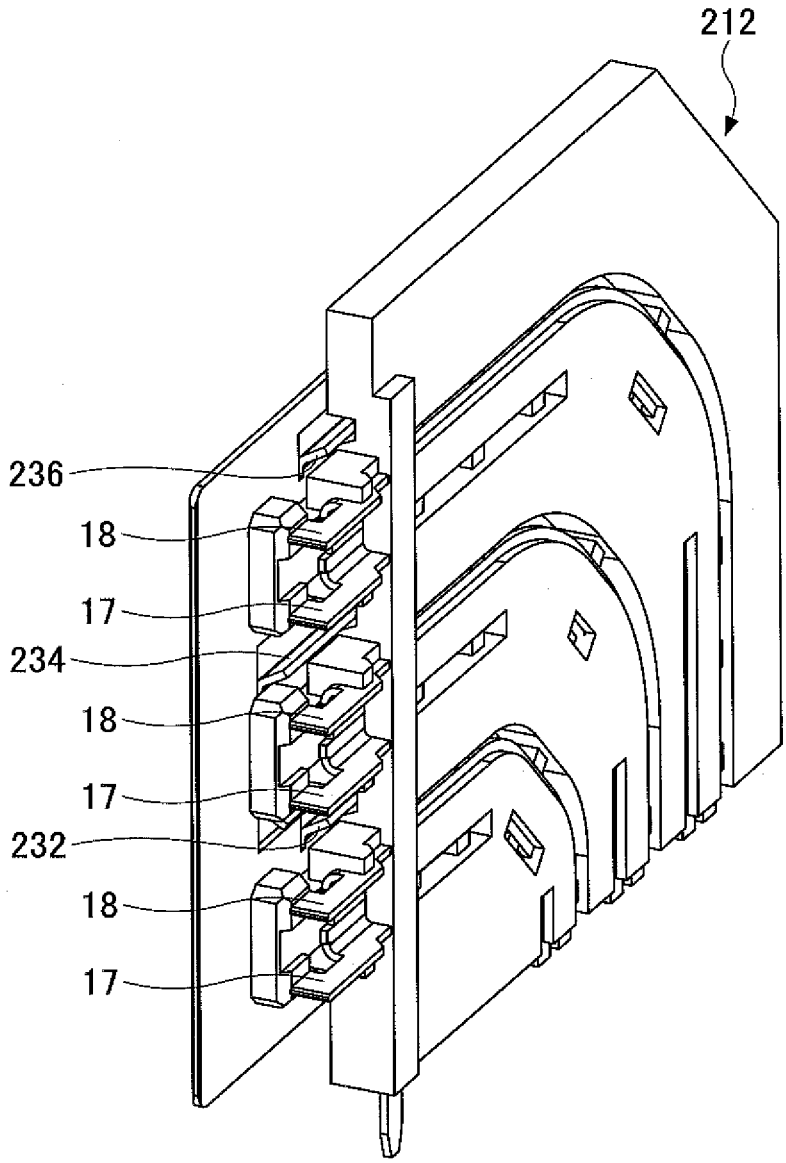
FIG. 30 is a perspective view (1) of the plug unit of the Third Embodiment.
Figure 31:
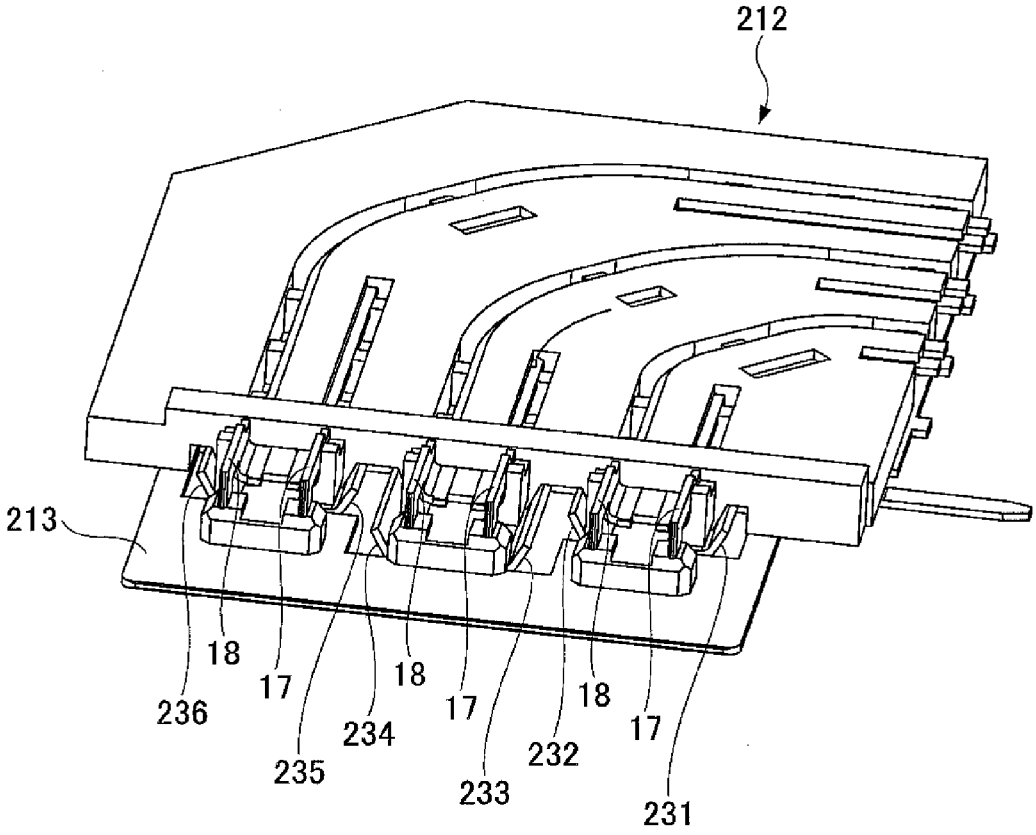
FIG. 31 is a perspective view (2) of the plug unit of the Third Embodiment.
Figure 32:
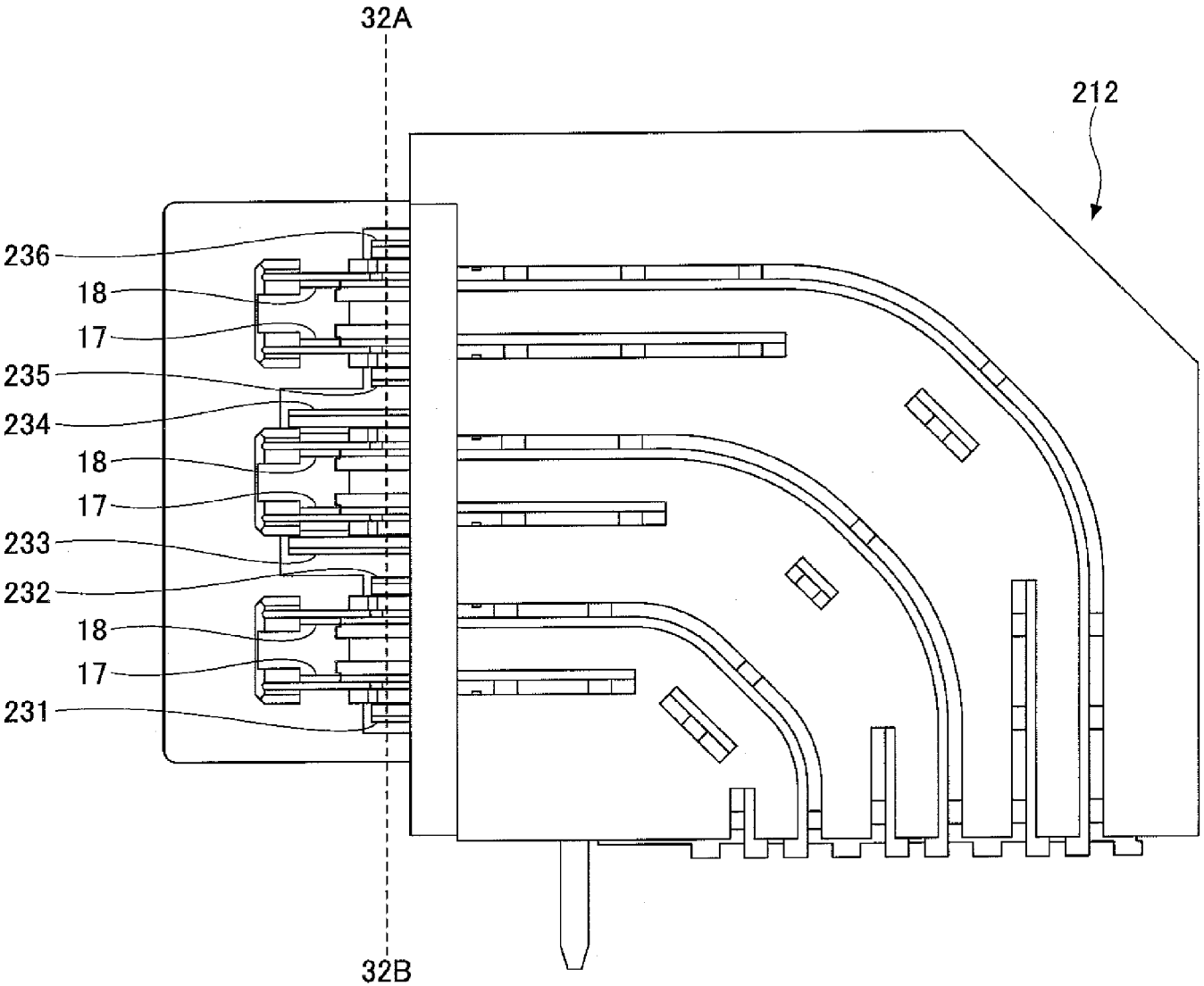
FIG. 32 is a plan view of the plug unit of the Third Embodiment.
Figure 33:
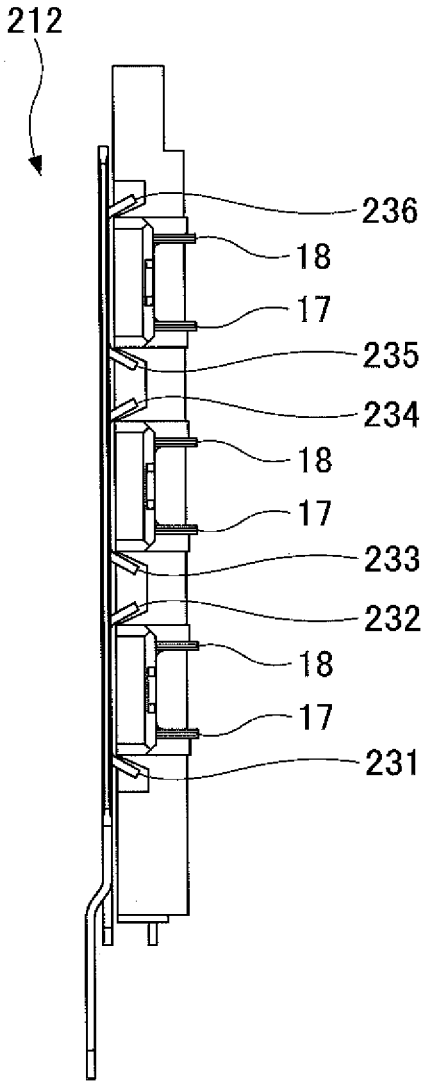
FIG. 33 is a side view of the plug unit of the Third Embodiment.
Figure 34:
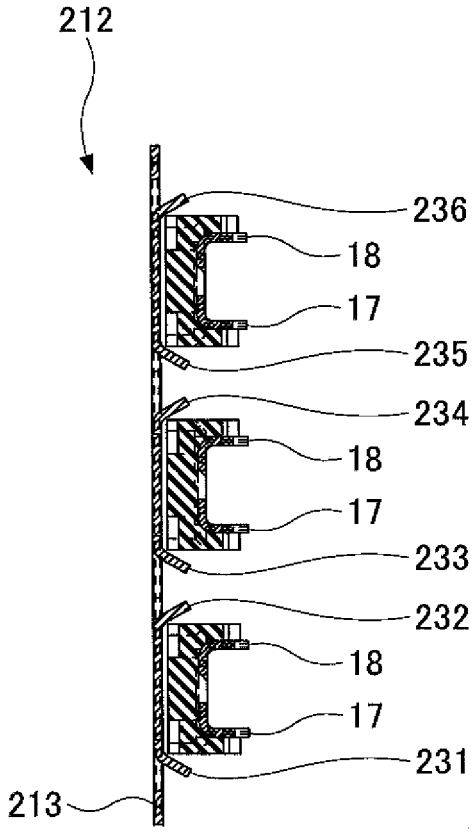
FIG. 34 is a cross-sectional view of the plug unit of the Third Embodiment.

A Third Embodiment is described next. An electronic connector of the Third Embodiment has the shape of a GND part on a plug unit different from that of First Embodiment. FIG. 28 is an exploded view of a plug unit 212 included in a plug electronic connector 10 of Third Embodiment. FIG. 29 is a perspective view of a GND part 213 included in the plug unit 212. FIG. 30 and FIG. 31 are perspective views of the plug unit 212 of the electronic connector of Third Embodiment. FIG. 32 is a plan view of the plug unit 212. FIG. 33 is a side view of the plug unit 212 viewed on a connecting side. FIG. 34 is a cross-sectional view of the plug unit 212 taken along a broken line 32A-32B of FIG. 32.

With Third Embodiment, the GND part 213 has plural pull-up parts 231, 232, 233, 234, 235 and 236. The pull-up parts 231, 232, 235 and 236 are shorter than the pull-up parts 233 and 234 in a connecting direction of the electronic connector. The lengths of the pull-up parts 231, 232, 233, 234, 235 and 236 are short relative to a portion of the GND part 213 exposed from an insulating unit of the plug unit 212 in the connecting direction of the electronic connector. By forming the pull-up parts 231, 232, 233, 234, 235 and 236 as shown in FIG. 29, the GND terminals 241 and 244 of a jack unit 222 of a jack electronic connector 20 may become longer than the GND terminals 242 and 243 of the jack unit 222 of the jack electronic connector 20 as illustrated in FIG. 35 to FIG. 38.

Specifically, a GND part provided in the jack unit 222 has four GND terminals 241, 242, 243 and 244 connected to a GND main body. In the GND terminals 241, 242, 243 and 244, there are two kinds of GND terminals having different lengths. The GND terminals 242 and 243 are positioned on an inner side, and the GND terminals 241 and 244 are positioned on an outer side and sandwiching the GND terminals 242 and 243.

The reason why the GND terminals 241 and 244 are formed to be longer than the GND terminals 242 and 243 is to prevent an apparatus from being destroyed by an influence of electrostatic charges. It is achieved by initially connecting the GND parts of the plug unit 212 and the jack unit 222. Said differently, the GND part 213 of the plug electronic connector is initially connected to the GND terminals 241 and 244 of the jack electronic connector.

Third Embodiment is applicable to the above plug electronic connector.

Figure 35:
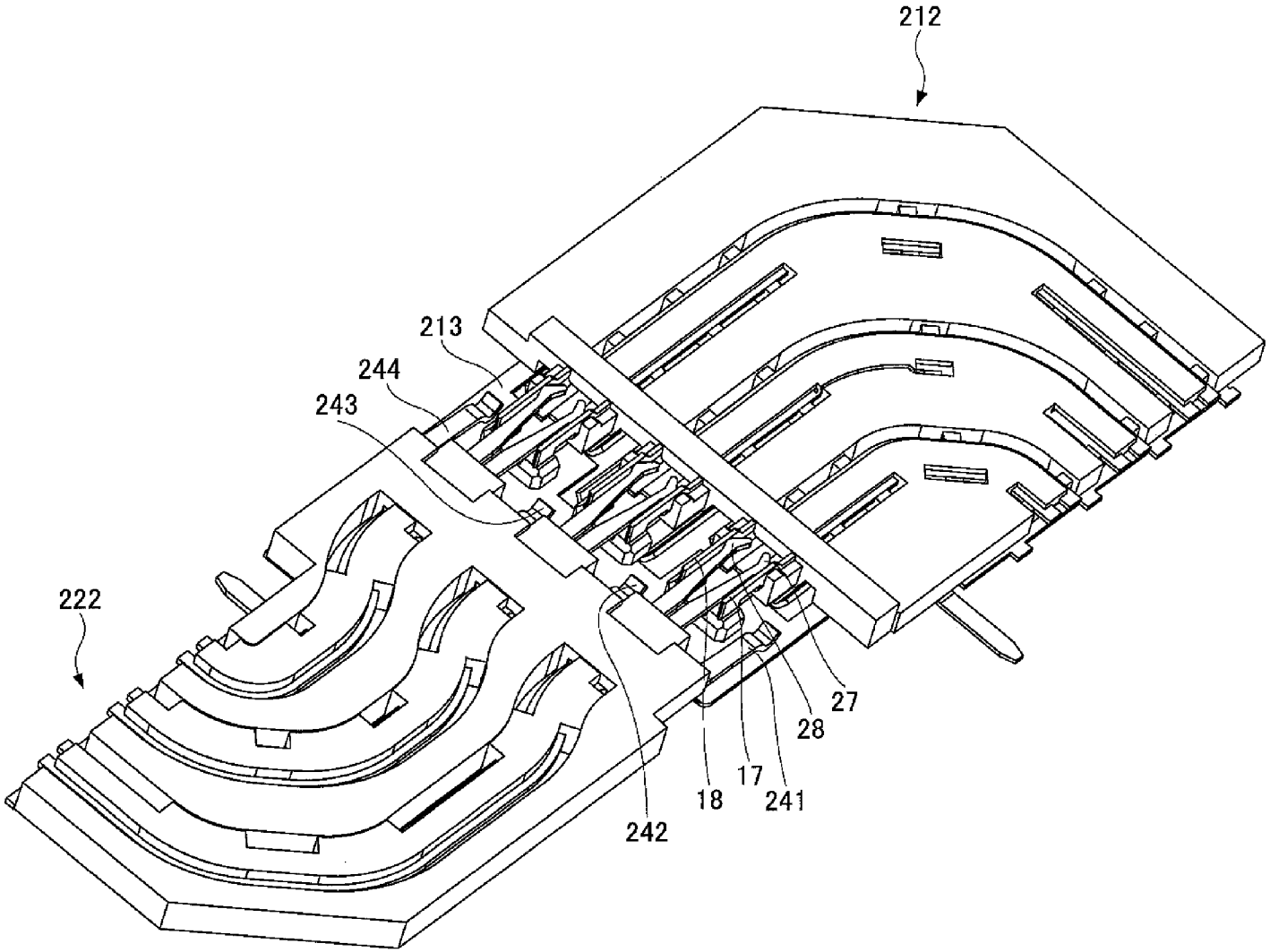
FIG. 35 is a perspective view of the electronic connector of the Third Embodiment under the connected state.
Figure 36:
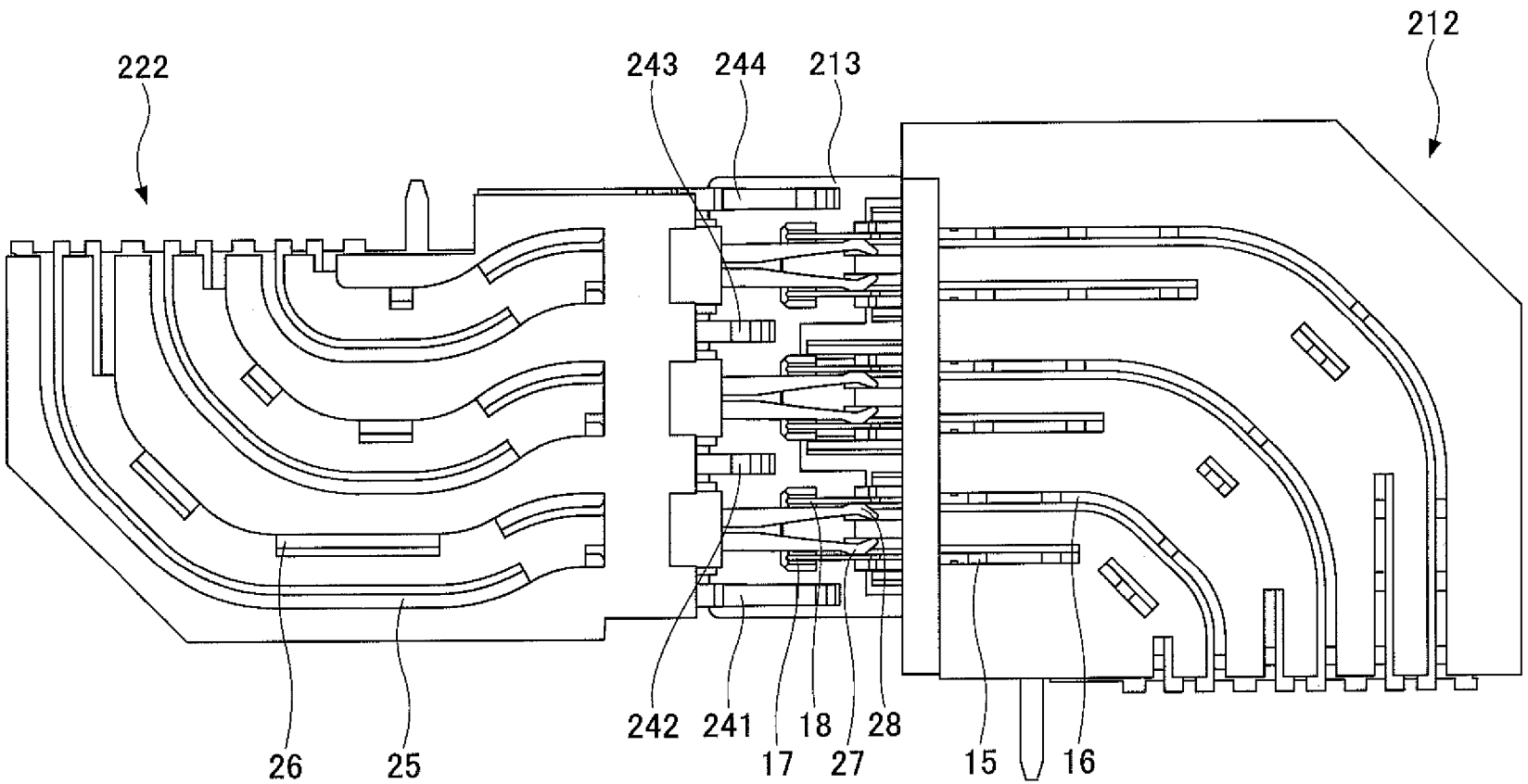
FIG. 36 is a plan view of the electronic connector of the Third Embodiment under the connected state.
Figure 37:
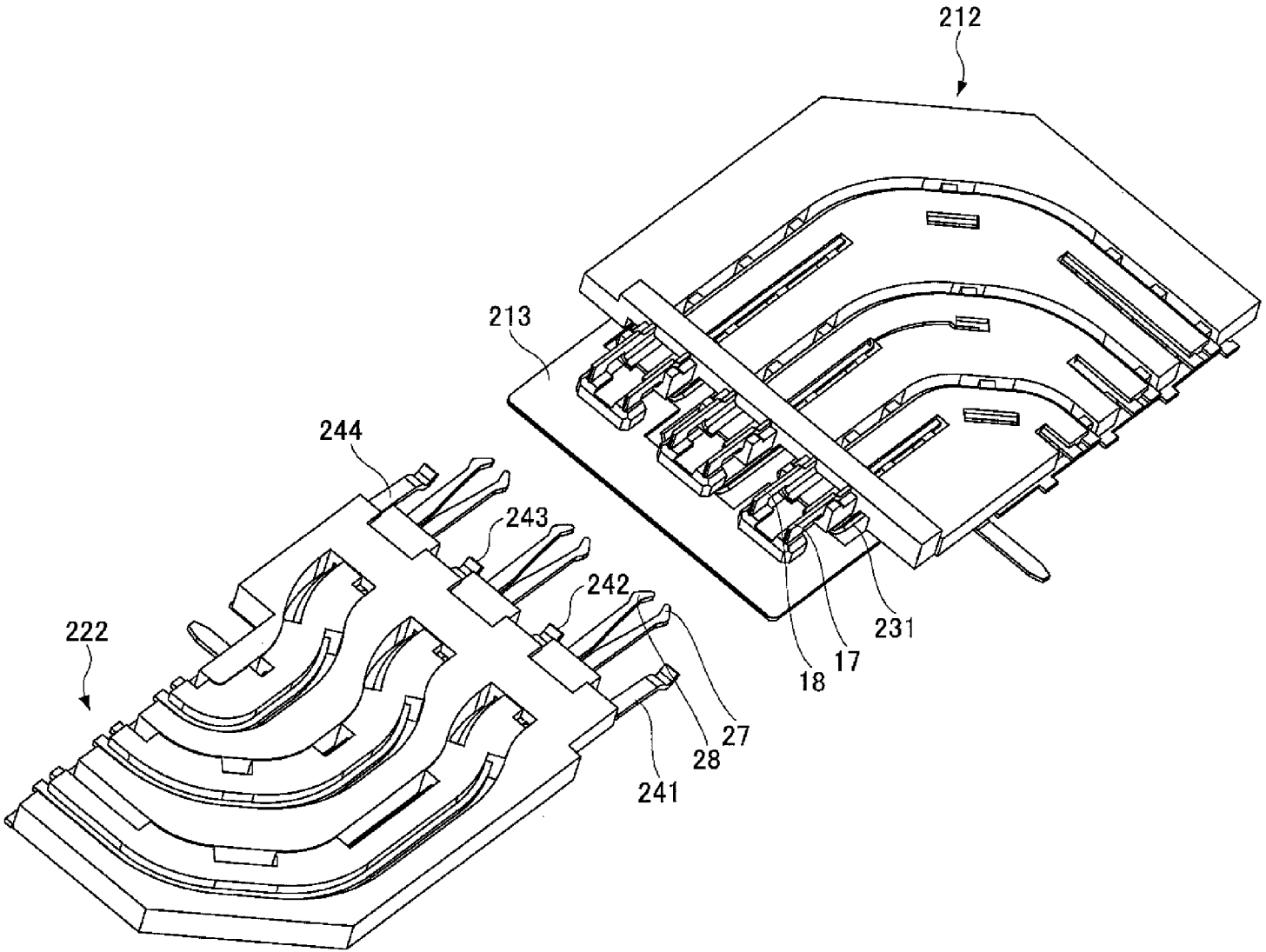
FIG. 37 is a perspective view of the electronic connector of the Third Embodiment under the unconnected state.
Figure 38:
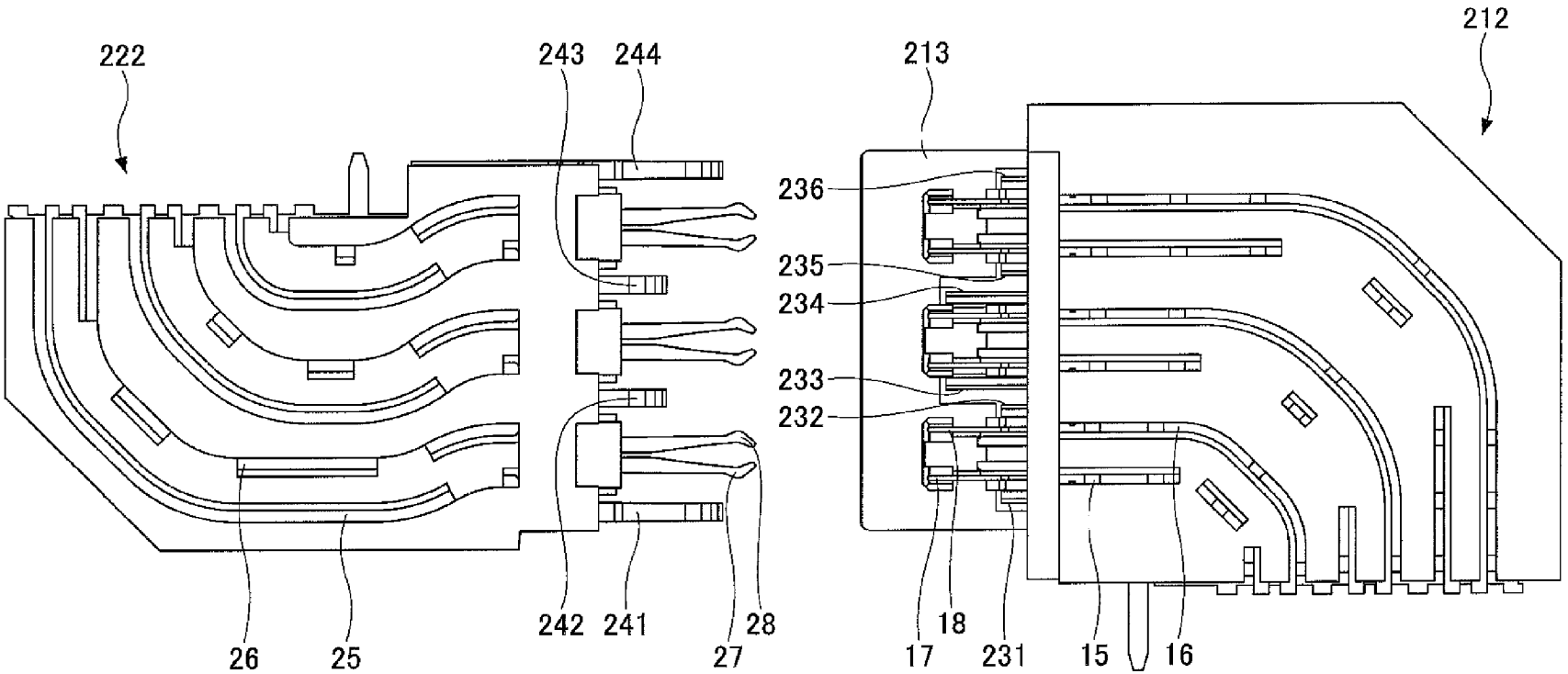
FIG. 38 is a plan view of the electronic connector of the Third Embodiment under the unconnected state.

FIG. 35 and FIG. 36 illustrate the plug unit 212 and the jack unit 222 under a connected state between the plug electronic connector 10 and the jack electronic connector 20. FIG. 35 is a perspective view of the plug unit 212 and the jack unit 222 under the connected state between the plug electronic connector and the jack electronic connector. FIG. 36 is a plan view of the plug unit 212 and the jack unit 222 under the connected state between the plug electronic connector and the jack electronic connector. FIG. 37 and FIG. 38 illustrate the plug unit 212 and the jack unit 222 under an unconnected state between the plug electronic connector 10 and the jack electronic connector 20. FIG. 37 is a perspective view of the plug unit 212 and the jack unit 222 under the unconnected state between the plug electronic connector 10 and the jack electronic connector 20. FIG. 38 is a plan view of the plug unit 212 and the jack unit 222 under the unconnected state between the plug electronic connector 10 and the jack electronic connector 20.

The other portions are the same as those in First Embodiment.

According to the embodiments of the present invention, it is possible to provide the electronic connector causing little degradation in transmitting high frequency signals and having a highly integrated structure suitable for the high frequency signals.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An electronic connector comprising:

a plurality of pairs of terminal parts for transmitting an electric signal; and a grounding part shaped like a plate and connected to have a ground potential, wherein the pairs of terminal parts are arranged substantially in parallel to a surface of the grounding part, each of the terminal parts being arranged substantially in parallel to the surface of the grounding part and including a terminal connecting part formed at an end of the terminal part so as to be connected to a terminal of another electronic connector, the terminal connecting parts of the same pair among the pairs of terminal parts being a pair of the terminal connecting parts and being arranged substantially in parallel to the surface of the grounding part, the grounding part has protrusions, which protrude from the surface of the grounding part and substantially in a vertical direction relative to the surface of the grounding part, each of the protrusions is provided on a side of one of the terminal connecting parts of the pair of terminal connecting parts, and the pair of terminal connecting parts is interposed between two protrusions among the protrusions, the two protrusions being adjacent on the surface of the grounding part.

2. The electronic connector according to claim 1, wherein the protrusions are provided on both sides of the pairs of terminal parts.

3. The electronic connector according to claim 1, wherein the protrusions are formed by cutting and pulling up parts of the grounding part.

4. The electronic connector according to claim 1, wherein the protrusions are formed by pushing out parts of the grounding part.

5. The electronic connector according to claim 1, wherein lengths of the protrusions in a direction of connecting the electronic connector are mutually different.

6. The electronic connector according to claim 1, wherein the grounding part, the pairs of terminal parts, and an insulating part provided between the grounding part and the pairs of terminal parts constitute a unit included in the electronic connector.

7. The electronic connector according to claim 6, wherein the unit is plural and the units are laminated in a direction substantially perpendicular to the surface of the grounding part.

8. A connector comprising:

a ground plate formed of a metal plate;

a pair of terminals, each terminal including a connecting part at its one end to be connected to a terminal of another connector, the terminals being arranged substantially in parallel to a surface of the ground plate; and a pair of protrusions formed on and protruding from a surface of the ground plate, wherein each of the protrusions is positioned adjacent to one of the connecting parts and between the adjacent pairs of terminals so that the connecting parts of the pair of terminals are positioned between the pair of the protrusions.

9. An electronic connector comprising:

a grounding part formed of a conductive plate; and a plurality of pairs of terminal parts for transmitting an electric signal, the terminal parts being arranged and aligned substantially in parallel to and along a surface of the grounding part, each of the terminal parts including a terminal connecting part formed at an end of the terminal part so as to be connected to a terminal of another electronic connector, wherein the grounding part has protrusions, which protrude from the surface of the grounding part and substantially in a vertical direction relative to the surface of the grounding part, each protrusion is provided on one side of one of the terminal connecting parts, and the pair of terminal parts is provided between two protrusions, which are adjacent along the surface of the grounding part.

* * * * *